US011007532B2

(12) United States Patent
Fredriksson et al.

(10) Patent No.: US 11,007,532 B2
(45) Date of Patent: May 18, 2021

(54) DRIVE MECHANISM FOR AN INERTIA CONE CRUSHER

(71) Applicant: SANDVIK INTELLECTUAL PROPERTY AB, Sandviken (SE)

(72) Inventors: Magnus Fredriksson, Dalby (SE); Martin Holstein, Limhamn (SE); Johan Gunnarsson, Sovde (SE); Jonas Lindvall, Lund (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 170 days.

(21) Appl. No.: 16/062,692

(22) PCT Filed: Dec. 18, 2015

(86) PCT No.: PCT/EP2015/080431
§ 371 (c)(1),
(2) Date: Jun. 15, 2018

(87) PCT Pub. No.: WO2017/102022
PCT Pub. Date: Jun. 22, 2017

(65) Prior Publication Data
US 2018/0369822 A1 Dec. 27, 2018

(51) Int. Cl.
*B02C 2/00* (2006.01)
*B02C 2/04* (2006.01)

(52) U.S. Cl.
CPC ..... *B02C 2/042* (2013.01); *B02C 2/00* (2013.01); *B02C 2/04* (2013.01)

(58) Field of Classification Search
CPC ..... B02C 2/042; B02C 2/00; B02C 2/04
See application file for complete search history.

(56) References Cited

U.S. PATENT DOCUMENTS 2,171,429 A 8/1939 Siegfried
3,227,381 A * 1/1966 Golucke ..... B02C 2/047 241/208

(Continued)

FOREIGN PATENT DOCUMENTS

EP 1839753 A2 10/2007
EP 2535111 A1 12/2012

(Continued)

OTHER PUBLICATIONS https://www.reich-kupplungen.com/en/products/highly-flexible-couplings/multi-cross-rillo.

*Primary Examiner* — Faye Francis
(74) *Attorney, Agent, or Firm* — Corinne R. Gorski

(57) ABSTRACT

A drive mechanism for an inertia cone crusher having a drive transmission to rotate an unbalanced mass body within the crusher and to cause a crusher head to rotate about a gyration axis at a tilt angle formed by an axis of the crusher head relative to the gyration axis. A torque reaction coupling is positioned in the drive transmission between the mass body and a drive input component and is elastically displaceable and/or deformable. In particular, the torque reaction coupling is configured to: i) transmit a torque from the drive input to the mass body and ii) to dynamically displace and/or deform elastically in response to a change in the torque resultant from a change in the tilt angle of the crusher head so as to dissipate the change in the torque to the drive transmission.

12 Claims, 15 Drawing Sheets

(56) References Cited

U.S. PATENT DOCUMENTS

| | | | | | |
|---|---|---|---|---|---|
| 3,539,119 | A * | 11/1970 | Cook | B02C 2/047 | 241/215 |
| 4,073,446 | A * | 2/1978 | Rundkvist | B02C 2/042 | 241/207 |
| 4,568,031 | A | 2/1986 | Mitrofanov | | |
| 4,655,405 | A | 4/1987 | Zarogatsky | | |
| 4,892,257 | A * | 1/1990 | Stoeckmann | B02C 2/047 | 241/208 |
| 5,996,915 | A * | 12/1999 | Cordonnier | B02C 2/042 | 241/207 |
| 7,954,735 | B2 | 6/2011 | Belotserkovskiy | | |
| 8,800,904 | B2 | 8/2014 | Belotserkovskiy | | |
| 2011/0155834 | A1 | 6/2011 | Kunch-Chi | | |
| 2015/0129696 | A1* | 5/2015 | Andrienko | B02C 2/042 | 241/215 |

FOREIGN PATENT DOCUMENTS

| | | | |
|---|---|---|---|
| EP | 2535112 | A1 | 12/2012 |
| FR | 2641478 | A1 | 7/1990 |
| SU | 762966 | A1 | 9/1980 |
| WO | 2006055610 | A2 | 5/2006 |
| WO | 2012005650 | A1 | 1/2012 |

* cited by examiner

DRIVE MECHANISM FOR AN INERTIA CONE CRUSHER

RELATED APPLICATION DATA

This application is a § 371 National Stage Application of PCT International Application No. PCT/EP2015/080431 filed Dec. 18, 2015.

FIELD OF INVENTION

The present invention relates to an inertia cone crusher and in particular although not exclusively, to a drive mechanism for an inertia cone crusher having a torque reaction coupling configured to inhibit transmission of changes in torque from an unbalanced mass body gyrating within the crusher to drive transmission components that provide rotational drive to the mass body.

BACKGROUND ART

Inertia cone crushers are used for the crushing of material, such as stone, ore etc., into smaller sizes. The material is crushed within a crushing chamber defined between an outer crushing shell (commonly referred to as the concave) which is mounted at a frame, and an inner crushing shell (commonly referred to as the mantle) which is mounted on a crushing head. The crushing head is typically mounted on a main shaft that mounts an unbalance weight via a linear bushing at an opposite axial end. The unbalance weight (referred to herein as an unbalanced mass body) is supported on a cylindrical sleeve that is fitted over the lower axial end of the main shaft via an intermediate bushing that allows rotation of the unbalance weight about the shaft. The cylindrical sleeve is connected, via a drive transmission, to a pulley which in turn is drivably connected to a motor operative for rotating the pulley and accordingly the cylindrical sleeve. Such rotation causes the unbalance weight to rotate about the a central axis of the main shaft, causing the main shaft, the crushing head and the inner crushing shell to gyrate and to crush material fed to the crushing chamber. Example inertia cone crushers are described in EP 1839753; U.S. Pat. Nos. 7,954,735; 8,800,904; EP 2535111; EP 2535112; US 2011/0155834.

However, conventional inertia crushers whilst potentially providing performance advantages over eccentric gyratory crushers, are susceptible to accelerated wear and unexpected failure due to the high dynamic performance and complicated force transmission mechanisms resulting from the unbalanced weight rotating around the central axis of the crusher. In particular, the drive mechanism that creates the gyroscopic precision of the unbalanced weight is exposed to exaggerated dynamic forces and accordingly component parts are susceptible to wear and fatigue. Current inertia cone crushers therefore may be regarded as high maintenance apparatus which is a particular disadvantage where such crushers are positioned within extended material processing lines.

SUMMARY OF THE INVENTION

It is an objective of the present invention to provide an inertia cone crusher and in particular a drive mechanism for an inertia cone crusher configured to impart rotational drive to an unbalanced weight whilst being configured to dissipate relatively large dynamic torque induced by the unbalanced weight gyrating within the crusher and to prevent the transmission of such torque to a drive transmission. It is a further specific objective to prevent or minimise accelerated wear, damage and failure of component parts of the drive transmission and/or the crusher generally.

The objectives are achieved and the above problems solved by a drive transmission arrangement or mechanism that, in part, isolates the rotating unbalanced weight and in particular the associated dynamic forces (principally torque) created during operation of the crusher from at least some components or parts of components of the upstream drive transmission being responsible to induce the rotation of the unbalanced mass body. In particular, the present drive transmission comprises a torque reaction coupling positioned intermediate a drive input component (that forms a part of the drive transmission at the crusher) and the unbalanced weight. The torque reaction coupling is configured to receive changes in the torque at the drive transmission (referred to herein as a 'reaction torque') created by the unbalanced weight as it is rotated about a gyration axis and to suppress, dampen, dissipate or diffuse the reaction torque and inhibit or prevent direct transmission into at least regions of the drive transmission components.

The torsional reactive coupling and its relative positioning is advantageous to support the mass body in a 'floating' arrangement within the crusher and to allow and accommodate non-circular orbiting motion of the crushing head (and hence main shaft) about the gyration axis causing in turn the unbalanced weight to deviate from its ideal circular rotational path. Accordingly the drive transmission components are partitioned from the torque resultant from undesired changes in the angular velocity of the unbalanced weight and/or changes in the radial separation of the main shaft and the centre of mass of the unbalanced weight from the gyration axis. Accordingly, the drive transmission, according to the present arrangement, is isolated from exaggerated and undesirable torque that result from the non-ideal, dynamic and uncontrolled movement of the oscillating mass body. The torque reaction coupling is configured to receive, store and dissipate energy received from the motion of the rotating mass body and to, in part, return at least some of this torque to the mass body as the reactive coupling displaces and/or deforms elastically in position within the drive transmission pathway. Such an arrangement is advantageous to reduce and to counter the large exaggerated torque so as to facilitate maintenance of a desired circular rotational path and angular velocity of the unbalanced mass about the gyration axis.

The present drive transmission arrangement accordingly provides a flexible or non-rigid connection to the unbalanced weight to allow at least partial independent movement (or movement freedom) of the unbalanced weight relative to at least parts of the upstream drive transmission such that the drive transmission has movement freedom to accommodate the torsional change. In particular, the centre of mass of the unbalanced weight is free to deviate from a predetermined (or ideal) circular gyroscopic precession and/or angular velocity without compromising the integrity of the drive transmission and other components within the crusher. The present apparatus and method of operation of the crusher is advantageous to prevent damage and premature failure of the crusher component parts and in particular those parts associated with the drive transmission.

According to a first aspect of the present invention there is provided a drive mechanism for an inertia cone crusher comprising a drive input component at the crusher forming part of a drive transmission to rotate an unbalanced mass body within the crusher and to cause a crusher head to rotate about a gyration axis, a torque reaction coupling positioned in the drive transmission between the mass body and the drive input component and being elastically displaceable and/or deformable, the torque reaction coupling configured to: i) transmit a torque from the drive input to the mass body and ii) to dynamically displace and/or deform elastically in response to a change in the torque resultant from a change in rotational motion of the crusher head about the gyration axis and/or a rotational speed of the crusher head so as to dissipate the change in the torque at the crusher.

Optionally, the crusher head may be aligned and rotated at a tilt angle formed by an axis of the crusher head relative to the gyration axis. The crusher head may be adapted to rotate about the gyration axis according to an ideal circular motion. The torque reaction coupling is configured to deflect and/or dissipate exclusively mechanical loading torque associated with the oscillating movement of the unbalanced weight (due to deviation of the crusher head (and hence the mass body and optionally the main shaft) form an ideal circular path) within the drive transmission, the drive input component or the mass body. That is, the torque reaction coupling is positioned and/or configured to be response exclusively to torsional change and to be unaffected by other transverse loading including in particular tensile, compressive, shear and frictional forces within the drive transmission Reference within the specification to 'a drive input component' encompasses a pulley wheel, a drive shaft, a torsion bar, a bearing race, a bearing housing, a drive transmission coupling, or drive transmission component including a component within the drive transmission that is positioned downstream (in the drive transmission pathway) of a drive belt (such as V-belts), a motor drive shaft, a motor or other power source unit, component or arrangement positioned upstream from the crusher. This term excludes a motor, belt drive and other drive transmission components mounted upstream of the drive input pulley of the crusher for inputting drive to the crusher. The reference herein to a drive input component encompasses a component that forms a part of and is integrated at the crusher. Optionally the flexible coupling may be mounted at a drive shaft of a motor that provides rotational drive to the crushing head. Optionally, the flexible coupling may be implemented as a component part of a drive pulley configured to transmit drive from the motor to the crushing head.

Reference within this specification to the torque reaction coupling being 'elastically displaceable and/or deformable' encompass the torque reaction coupling configured to move relative to other components within the drive transmission and/or to displace relative to a 'normal' operation position of the torque reaction coupling when transmitting driving torque to the mass body at a predetermined torque magnitude without influence or change in the torque resultant from changes in the tilt angle of the crusher head. This term encompasses the torque reaction coupling comprising a stiffness sufficient to transmit a drive torque to at least part of the mass body whilst being sufficiently responsive by movement/deformation in response to change in the torque at the drive transmission, the mass body or drive input component. The term 'dynamically displace' encompasses rotational movement and translational shifting of the torque reaction coupling in response to the deviation of the main shaft from the circular orbiting path.

Preferably, the torque reaction coupling is mechanically attached, anchored or otherwise linked to the drive transmission, and in particular other components associated with the rotation drive imparted to the crusher head, and comprises at least a part or region that is configured to rotate or twist about an axis so as to absorb the changes in torque. Preferably, at least respective first and second attachment ends or regions of the torque reaction coupling are mechanically fixed or coupled to components within the drive transmission such that at least a further part or region of the torque reaction coupling (positionally intermediate the first and second attachment ends or regions) is configured to rotate or twist relative to (and independently of) the static first and second attachment ends or regions.

The term 'change in rotational motion of the crusher head' encompasses deviation of the crusher head, from a desired circular orbiting path about the gyration axis. Where the crusher head is inclined at a tilt angle, the change in rotational motion of the crusher head may comprise a change in the tilt angle. Optionally, the crusher head may be aligned parallel with a longitudinal axis of the crusher such that the deviation from the circular orbiting path is a translational displacement. The reference herein to a 'change in the rotational speed of the crusher head' encompasses sudden changes in angular velocity of the head and accordingly the mass body that in turn result in inertia changes within the system that are transmitted through the drive transmission and manifest as torque.

Preferably, at least regions of the torque transmission coupling are anchored to the drive transmission that includes portions of the drive input component and mass body. Accordingly, the regions of connection of the torque transmission coupling to the drive transmission, the drive input component or mass body may be regarded as static or rigid so as to transmit the torque. Preferably, the torque reaction coupling comprises mounting attachments to mount the coupling in position at the mass body, the drive input component or within the drive transmission pathway between the mass body and the drive input component. The attachments may comprise mechanical attachment components such as bolts, pins or clips or may comprise respective abutment faces that are forced against corresponding components of the drive transmission including at least parts of the mass body or drive input component.

Optionally, the torque reaction coupling is positioned within the crusher frame. Optionally, the torque reaction coupling is positioned immediately below the crusher. Optionally, the torque reaction coupling is aligned so as to be positioned on the longitudinal axis extending through the crusher head and/or main shaft when the crusher is non-operative or immobile. Optionally, the torque reaction coupling is positioned within a perimeter of an orbiting path defined by the unbalanced weight as it rotates within the crusher. Optionally, the torque reaction coupling is positioned so as to be integral or incorporated within the unbalanced weight or drive input component.

The crusher head is configured to support a mantle, wherein the mass body is provided at or connected to the crusher head. Optionally the mass body is connected to the crusher head via a main shaft or the mass body is integrated at or mounted within the crusher head. Optionally, the mass body may be connected directly or integral with the crusher head such that the crusher does not comprise a main shaft. Preferably, the crusher head comprises a cone or dome shape profile. Optionally, the unbalanced weight is accommodated within the body of the crusher head to preserve the cone shaped profile.

Preferably, the drive transmission comprises at least one further drive transmission component coupled to the mass body and the drive input component to form part of the drive transmission. Optionally, the further drive transmission component may comprise a torsion rod, drive shaft, pulley, bearing assembly, bearing race, torsion bar mounting socket or bushing connecting the unbalanced weight to a power unit such as a motor.

Optionally, the torque reaction coupling is elastically deformable relative to the drive input component and/or the further drive transmission component. That is, the torque reaction coupling comprises a structure or component parts configured to move internally within the coupling and/or the entire torque reaction coupling is configured to move relative to the gyration axis and/or other components within the drive transmission such as the drive input component or mass body. Optionally, the torque reaction coupling comprises a modular assembly construction formed from a plurality of component parts in which a selection of the component parts are configured to move relative to one another during deformation of the torque reaction coupling.

Optionally, the torque reaction coupling comprises a spring. Optionally, the spring is a helical or coil spring. Optionally, the spring comprises any one or a combination of the following: a torsion spring, a coil spring, a helical spring, a gas spring, a torsion disc spring, or a compression spring. Optionally, the spring comprises any cross-sectional shape profile including for example rectangular, square, circular, oval etc. Optionally the spring may be formed from an elongate metal strip coiled into a circular spiral.

Optionally, the torque reaction coupling comprises a torsion bar configured to twist about its central axis in response to differences in torque at each respective end of the bar.

Optionally, the torque reaction coupling comprises a plurality of force reaction components such as springs of different types or configurations and torsion bars mounted at the crusher optionally within the drive transmission in series and/or in parallel.

Optionally, the spring comprises a stiffness in the range 100 Nm/degrees to 1500 Nm/degrees and a damping coefficient (in Nm·s/degree) of less than 10%, 5%, 3%, 1%, 0.5% or 0.1% of the stiffness depending on the power of the crusher motor and the mass of the unbalanced weight. Such an arrangement is advantageous to enable the spring to transmit a drive torque whilst being sufficiently flexible to deform in response to the reaction torque. In particular, the flexible couplings may be configured to twist between its connection ends (connected to the unbalanced mass, drive input component and/or intermediate drive coupling components) by an angle in the range +/−45°. Accordingly, the flexible coupling is configured to twist internally (with reference to its connection ends) by an angle up to 70°, 80°, 90°, 100°, 110°, 120°, 130° or 140° in both directions. Such a range of twist excludes an initial deflection due to torque loading when the crusher is operational and the flexible coupling is acted upon by the drive torque. Such initial torsional preloading may involve the coupling deflecting by 10 to 50°, 10 to 40°, 10 to 30°, 10 to 25°, 15 to 20° or 20 to 30°. Advantageously, the elastic coupling is capable of deflecting further beyond the initial torsional preloading so as to be capable of 'winding' or 'unwinding' from the initial (e.g., 15 to 20°) deflection. Optionally, the torsional responsive coupling comprises a maximum deflection, that may be expressed as a twist of up to 90° in both directions. Optionally, the coupling may be configured to deflect by 5 to 50%, 5 to 40%, 5 to 30%, 5 to 20%, 5 to 10%, 10 to 40%, 20 to 40%, 30 to 40%, 20 to 40%, 20 to 30%, 10 to 50%, 10 to 30% or 10 to 20% of the maximum deflection in response to the 'normal' loading torque transmitted through the coupling when the crusher is active optionally pre or during crushing operation.

Optionally, torque reaction coupling comprises a first part anchored to the mass body or a component coupled to the mass body and a second part anchored to the drive input component or a coupling forming part of the drive transmission and coupled to the drive input component such that the torque reaction coupling is elastically displaceable and/or deformable in anchored position between the drive input component and the mass body. The first and second parts may comprise respective ends of the spring and/or mounting attachment components such as bolts and rivets, pins or other coupling attachments to secure component parts of the drive transmission as a unitary assembly.

The torque reaction coupling is advantageous so as to be configured to be mounted in the drive transmission, or at the mass body or drive input to store the change in the torque and to displace and/or deform relative to any one of: the drive input component, parts of the mass body, the crusher frame, a gyration axis, a central axis of the crusher or the respective mounting portions of the reaction coupling that connect the coupling to the drive transmission, the mass body or drive input component so as to dissipate the change in torque within the crusher and in particular regions of the drive transmission. Preferably, the torque reaction coupling is configured to displace and/or deform in response to the change in the torque due to deviations from a substantially circular motion of the crusher head around the gyration axis. The deviations from the circular orbiting path of the mass body may accordingly result from deviations by the crusher head from the tilt angle that, in turn, may result from changes in the type, flow rate or volume of material within the crushing zone (between the concave and mantle) and/or the shape and in particular imperfections or wear of the mantle and concave.

According to a second aspect of the present invention there is provided an inertia crusher comprising: a frame to support an outer crushing shell; a crusher head moveably mounted relative to the frame to support an inner crushing shell to define a crushing zone between the outer and inner crushing shells; and a drive mechanism according to the claims herein.

According to a third aspect of the present invention there is provided a method of operating an inertia crusher comprising: inputting a torque to a drive input component at the crusher forming part of a drive transmission; transmitting drive from the drive input component to an unbalanced mass body to cause a crusher head to rotate about a gyration axis at a tilt angle formed by an axis of the crusher head relative to the gyration axis; partitioning the drive transmission between the drive input component and the mass body via an elastically displaceable and/or deformable torque reaction coupling configured to allow the torque to be transmitted from the drive input component to the mass body; inhibiting the transmission of a change in the torque resultant from a change in the rotational motion of the crusher head about the gyration axis and/or a rotational speed of the crusher head to at least part of the drive transmission via displacement and/or deformation of the torque reaction coupling.

The present torque reaction coupling is advantageous to be dynamically responsive to changes in the tilt angle caused by change in the rotational path and/or the angular velocity of the mass body that in turn causes the change in torque within the drive transmission. The present torque reaction coupling therefore provides a flexible linkage to accommodate undesired and unpredicted torsion created by rotation of the mass body.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
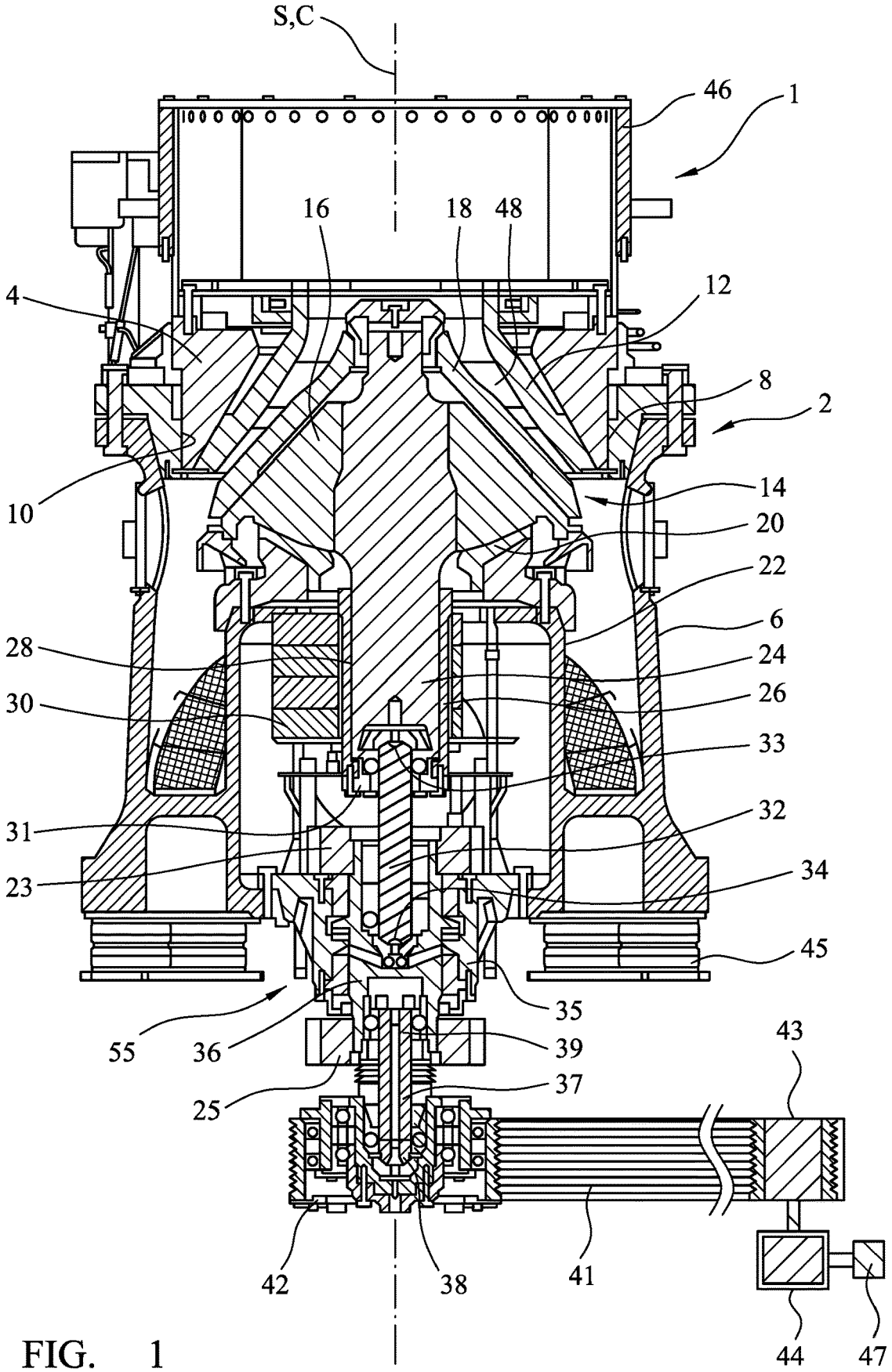
FIG. 1 is a cross-sectional view through an inertia cone crusher according to one specific implementation of the present invention.

FIG. 1 illustrates an inertia cone crusher 1 in accordance with one embodiment of the present invention. The inertia crusher 1 comprises a crusher frame 2 in which the various parts of the crusher 1 are mounted. Frame 2 comprises an upper frame portion 4, and a lower frame portion 6. Upper frame portion 4 has the shape of a bowl and is provided with an outer thread 8, which cooperates with an inner thread 10 of lower frame portion 6. Upper frame portion 4 supports, on the inside thereof, a concave 12 which is a wear part and is typically formed from a manganese steel.

Lower frame portion 6 supports an inner crushing shell arrangement represented generally by reference 14. Inner shell arrangement 14 comprises a crushing head 16, having a generally coned shape profile and which supports a mantle 18 that is similarly a wear part and typically formed from a manganese steel. Crushing head 16 is supported on a part-spherical bearing 20, which is supported in turn on an inner cylindrical portion 22 of lower frame portion 6. The concave and mantle 12, 18 form between them a crushing chamber 48, to which material that is to be crushed is supplied from a hopper 46. The discharge opening of the crushing chamber 48, and thereby the crushing capacity, can be adjusted by means of turning the upper frame portion 4, by means of the threads 8,10, such that the vertical distance between the concave and mantle 12, 18 is adjusted. Crusher 1 is suspended on cushions 45 to dampen vibrations occurring during the crushing action.

The crushing head 16 is mounted at or towards an upper end of a main shaft 24. An opposite lower end of shaft 24 is encircled by a bushing 26, which has the form of a cylindrical sleeve. Bushing 26 is provided with an inner cylindrical bearing 28 making it possible for the bushing 26 to rotate relative to the crushing head shaft 24 about an axis S extending through head 16 and shaft 24.

An unbalance weight 30 is mounted eccentrically at (one side of) bushing 26. At its lower end, bushing 26 is connected to the upper end of a drive transmission mechanism indicated generally by reference 55. Drive transmission 55 comprises a torque reaction coupling 32 in the form of a helical spring having a first upper end 33 and a second lower end 34. The first end 33 is connected to a lowermost end of bushing 26 whilst second end 34 is mounted in coupled arrangement with a drive shaft 36 rotatably mounted at frame 6 via a bearing housing 35. A torsion bar 37 is drivably coupled to a lower end of drive shaft 36 via its first upper end 39. A corresponding second lower end 38 of torsion bar 37 is mounted at a drive pulley 42. An upper balanced weight 23 is mounted to an axial upper region of drive coupling 36 and a lower balanced weight 25 is similarly mounted at an axial lower region to drive coupling 36. According to the specific implementation, torque reaction coupling 32, drive shaft 36, bearing housing 35, torsion bar 37 and pulley 42 are aligned coaxially with one another, main shaft 24 and crushing head 16 so as to be centred on axis S. Drive pulley 42 mounts a plurality of drive V-belts 41 extending around a corresponding motor pulley 43. Pulley 43 is driven by a suitable electric motor 44 controlled via a control unit 47 that is configured to control the operation of the crusher 1 and is connected to the motor 44, for controlling the RPM of the motor 44 (and hence its power). A frequency converter, for driving the motor 44, may be connected between the electric power supply line and the motor 44.

According to the specific implementation, drive mechanism 55 comprises four CV joints at the regions of the respective mounting ends 33 and 34 of the torque reaction coupling 32 and the respective ends 39, 38 of the torsion bar 37. Accordingly, the rotational drive of the pulley 42 by motor 44 is translated to bushing 26 and ultimately unbalanced weight 30 via drive transmission components 32, 36, 37 coupled to pulley 42 which may be regarded as a drive input component of crusher 1. Pulley 42 is centred on a generally vertically extended central axis C of crusher 1 that is aligned coaxially with shaft and head axis S when the crusher 1 is stationary.

Figure 2:
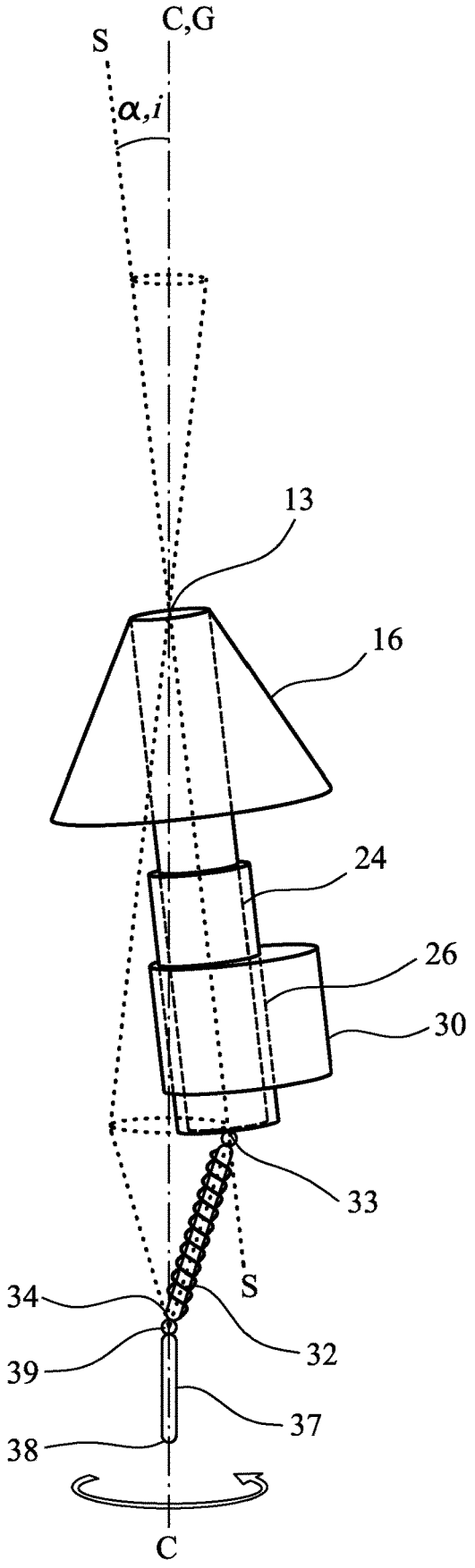
FIG. 2 is a schematic side view of selected moving components within the inertia crusher of FIG. 1 including in particular the crushing head, the unbalanced weight and drive transmission.

When the crusher 1 is operative, the drive transmission components 32, 36, 37 and 42 are rotated by motor 44 to induce rotation of bushing 26. Accordingly, bushing 26 swings radially outward in the direction of the unbalance weight 30, displacing the unbalance weight 30 away from crusher vertical reference axis C in response to the centrifugal force to which the unbalance weight 30 is exposed. Such displacement of the unbalance weight 30, and bushing 26 (to which the unbalance weight 30 is attached), is achieved due to the flexibility of the CV joints at the various regions of drive transmission 55. Additionally, the desired radial displacement of weight 30 is accommodated as the sleeve-shaped bushing 26 is configured to slide axially on the main shaft 24 via cylindrical bearing 28. The combined rotation and swinging of the unbalance weight 30 results in an inclination of the main shaft 24, and causes head and shaft axis S to gyrate about the vertical reference axis C as illustrated in FIG. 2 such that material within crushing chamber 48 is crushed between the concave and mantle 12, 18. Accordingly, under normal operating conditions, a gyration axis G, about which crushing head 16 and shaft 24 will gyrate, coincides with the vertical reference axis C.

FIG. 2 illustrates the gyrating motion of the central axis S of the shaft 24 and head 16 about the gyration axis G during normal operation of the crusher 1. For reasons of clarity, only the rotating parts are illustrated schematically. As the drive shaft 36 rotates the torque reaction coupling 32 and the unbalance bushing 26, the unbalance weight 30 swings radially outward thereby tilting the central axis S of the crushing head 16 and the shaft 24 relative to the vertical reference axis C by an inclination angle i. As the tilted central axis S is rotated by the drive shaft 36, it will follow a gyrating motion about the gyration axis G, the central axis S thereby acting as a generatrix generating two cones meeting at an apex 13. A tilt angle $\alpha$, formed at the apex 13 by the central axis S of head 16 and the gyration axis G, will vary depending on the mass of the unbalance weight 30, the RPM at which the unbalance weight 30 is rotated, the type and amount of material that is to be crushed, the DO setting and the shape profile of the concave and mantle 18, 12. For example, the faster the drive shaft 36 rotates, the more the unbalance weight 30 will tilt the central axis S of the head 16 and the shaft 24. Under the normal operating conditions illustrated in FIG. 2, the instantaneous inclination angle i of the head 16 relative to the vertical axis C coincides with the apex tilt angle $\alpha$ of the gyrating motion. In particular, when the drive transmission components 33, 36, 37 and 42 are rotated the unbalanced weight 30 is rotated such that the crushing head 16 gyrates against the material to be crushed within the crushing chamber 48. As the crushing head 16 rolls against the material at a distance from the periphery of the concave 12, central axis S of crushing head 16, about which axis the crushing head 16 rotates, will follow a circular path about the gyration axis G. Under normal operating conditions the gyration axis G coincides with the vertical reference axis C. During a complete revolution, the central axis S of the crushing head 16 passes from 0-360°, at a uniform speed, and at a static distance from the vertical reference axis C.

However, the desired circular gyroscopic precession of head 16 about axis C is regularly disrupted due to many factors including for example the type, volume and non-uniform delivery speed of material within the crushing chamber 48. Additionally, asymmetric shape variation of the concave and mantle 12, 18 acts to deflect axis S (and hence the head 16 and unbalanced weight 30) from the intended inclined tilt angle i. Sudden changes from the intended rotational path of the main shaft relative to axis G and/or sudden changes in the angular velocity (referred to herein as speed) of the unbalanced weight 30 manifest as substantial exaggerated dynamic torsional changes that are transmitted into the drive transmission components 32, 36, 37 and 42. Such dynamic torque can result in accelerated wear, fatigue and failure of the drive transmission 55 and indeed other components of the crusher 1.

Torque reaction coupling 32, according to the specific embodiment, functions like an elastic spring that is configured to deform elastically in response to receipt of the dynamic torque resultant from the undesired and uncontrolled movement and speed of unbalanced weight 30. In particular, spring 32 is adapted to be self-adjusting via radial and axial expansion and contraction as torque is transmitted from a bearing race (mounted at an axial lower end 31 of bushing 26) to spring upper end 33 and then spring lower end 34. Accordingly, the reaction torque resultant from the exaggerated motion of unbalanced weight 30 is dissipated by coupling 32 and is inhibited and indeed prevented from transmission to the remaining drive transmission components 36, 37 and 42. Torque reaction component 32 is configured to receive, store and at least partially return torque to the bushing 26 and unbalanced weight 30. Accordingly, unbalanced weight 30 via coupling 32 is suspended in a 'floating' arrangement relative to the remaining drive transmission components 36, 37 and 42. That is, coupling 32 enables a predetermined amount of change in the tilt angle i of weight 30 in addition to changes in the angular velocity of weight 30 relative to the corresponding rotational drive of components 36, 37 and 42

Figure 3:
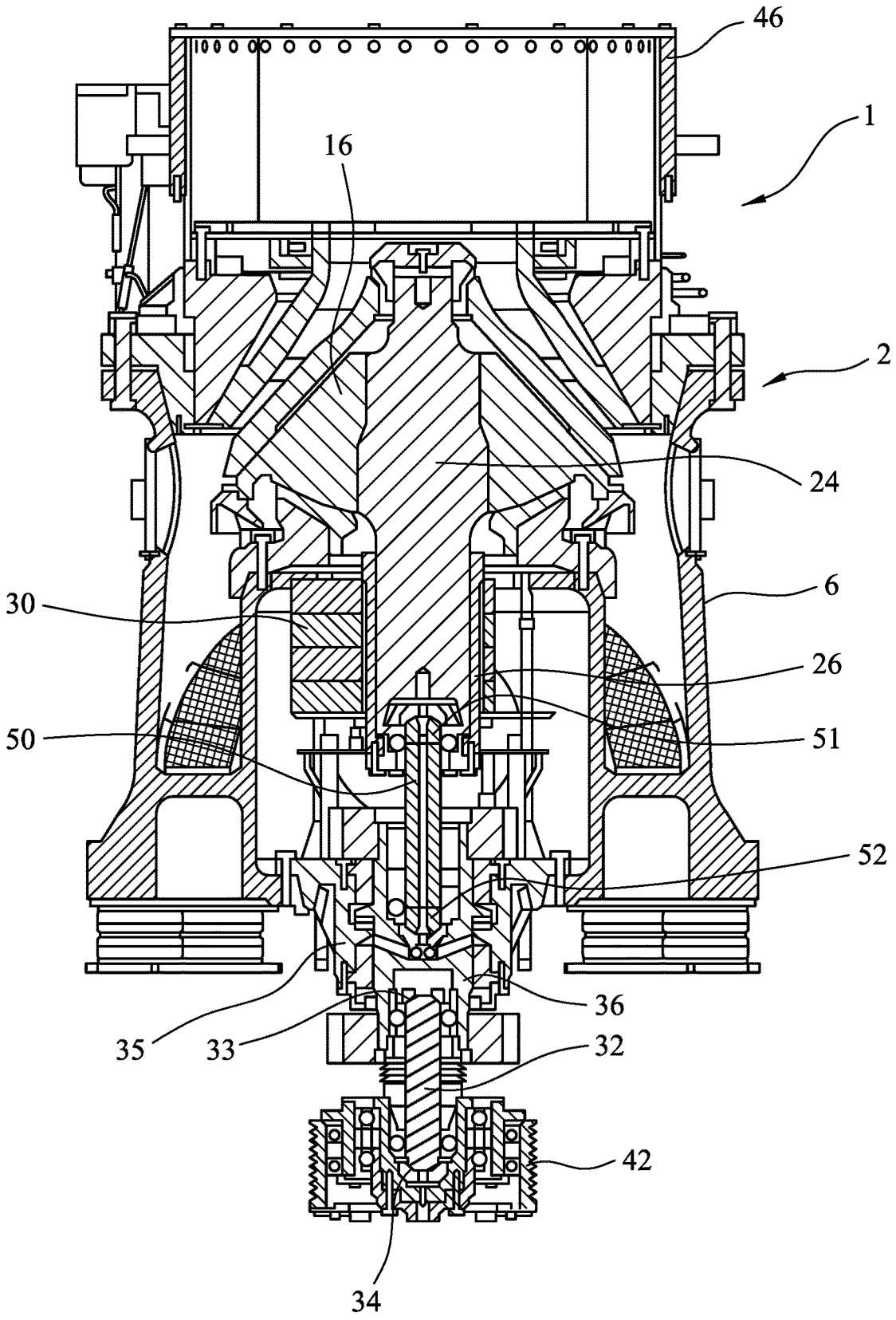
FIG. 3 is a cross-sectional view of an inertia cone crusher according to a further specific implementation of the present invention.

FIG. 3 illustrates a further embodiment in which the drive transmission 55 comprises an axially upper torsion bar 50 connected at its upper end 51 to bushing 26 and at its lower end 52 to drive shaft 36. The torque reaction coupling 32 in the form of a spring is effectively mounted to replace the lower torsion bar of FIG. 1 and is mounted axially in position between a lower end of drive shaft 36 and drive pulley 42. Accordingly, a drive torque from motor 44 is transmitted to the crusher via drive pulley 42, torque reaction coupling 32, drive shaft 36, upper torsion bar 50, bushing 26 and ultimately to unbalanced weight 30. As detailed with reference to FIG. 1, the torque reaction coupling 32 (positioned at a low region of the drive transmission) is configured to move by elastic deformation to dissipate the reaction torque generated by unbalanced mass 30.

Figure 4:
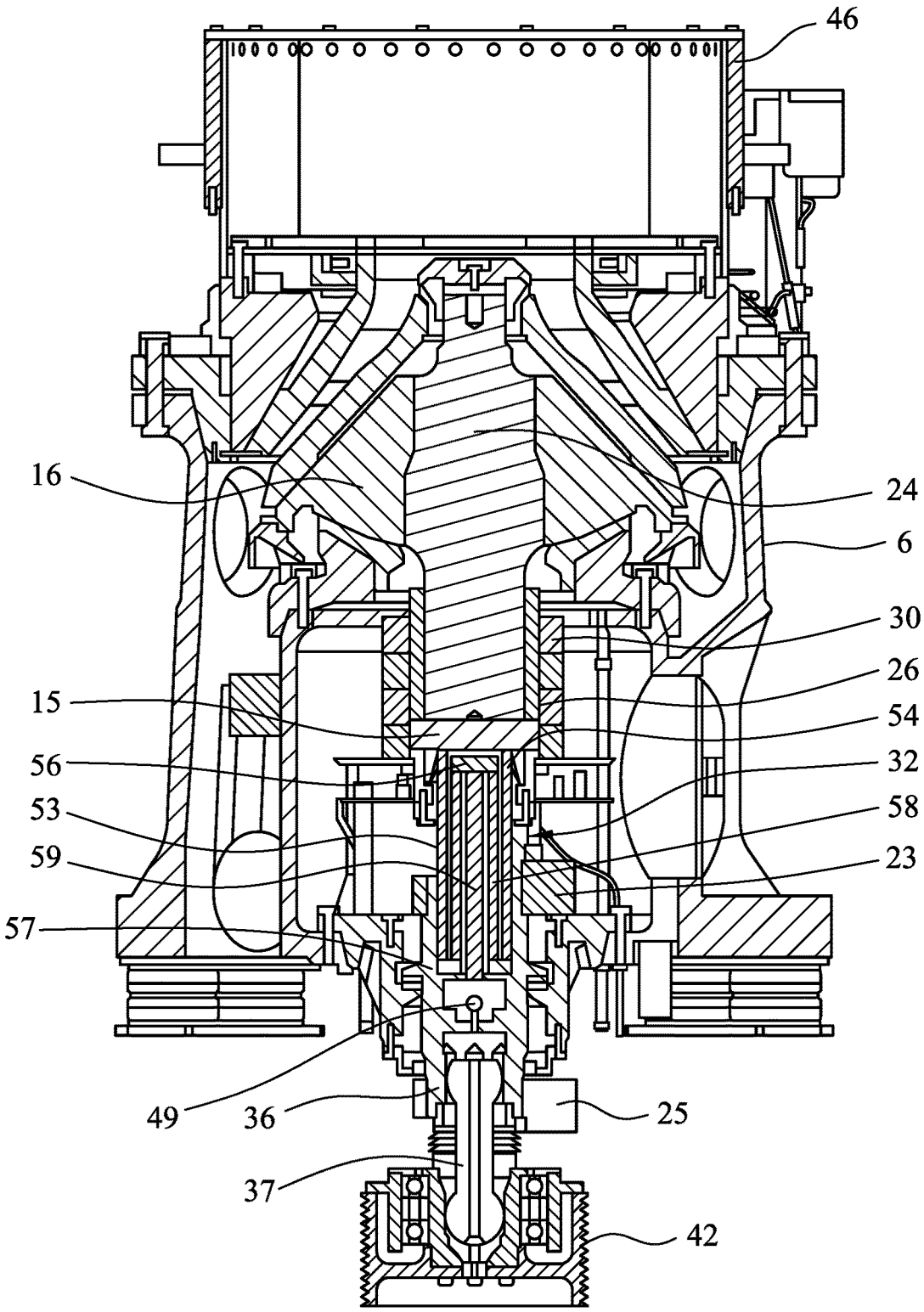
FIG. 4 is a cross-sectional view of an inertia cone crusher according to a further specific implementation of the present invention.

FIG. 4 illustrates a further embodiment according to a variation of the embodiment of FIG. 1. A torsion rod indicated generally by reference 53 represents the torque reaction coupling 32. Torsion rod 53 is positioned axially between bushing 26 and the drive shaft 36. In particular, a first axial upper end of torsion rod 53 is mounted via a rigid mounting 15 to bushing 26. An axial lower end of rod 53 is similarly mounted via a rigid mount 49 to drive shaft 36. Torsion rod 53 comprises a plurality of concentrically mounted tubes each configured to twist about an axis of the rod 53 in response to the reaction torque generated by unbalanced mass 30. Rod 53 comprises a first radially outer tube 54, a centrally positioned radially innermost rod or tube 59 and an intermediate tube 58 positioned between the innermost and outer components 59, 54. The respective components 54, 59 and 58 are coupled together at their respective axial ends via a first axially upper assembly mount 56 and a second axially lower assembly mount 57.

Figure 5:
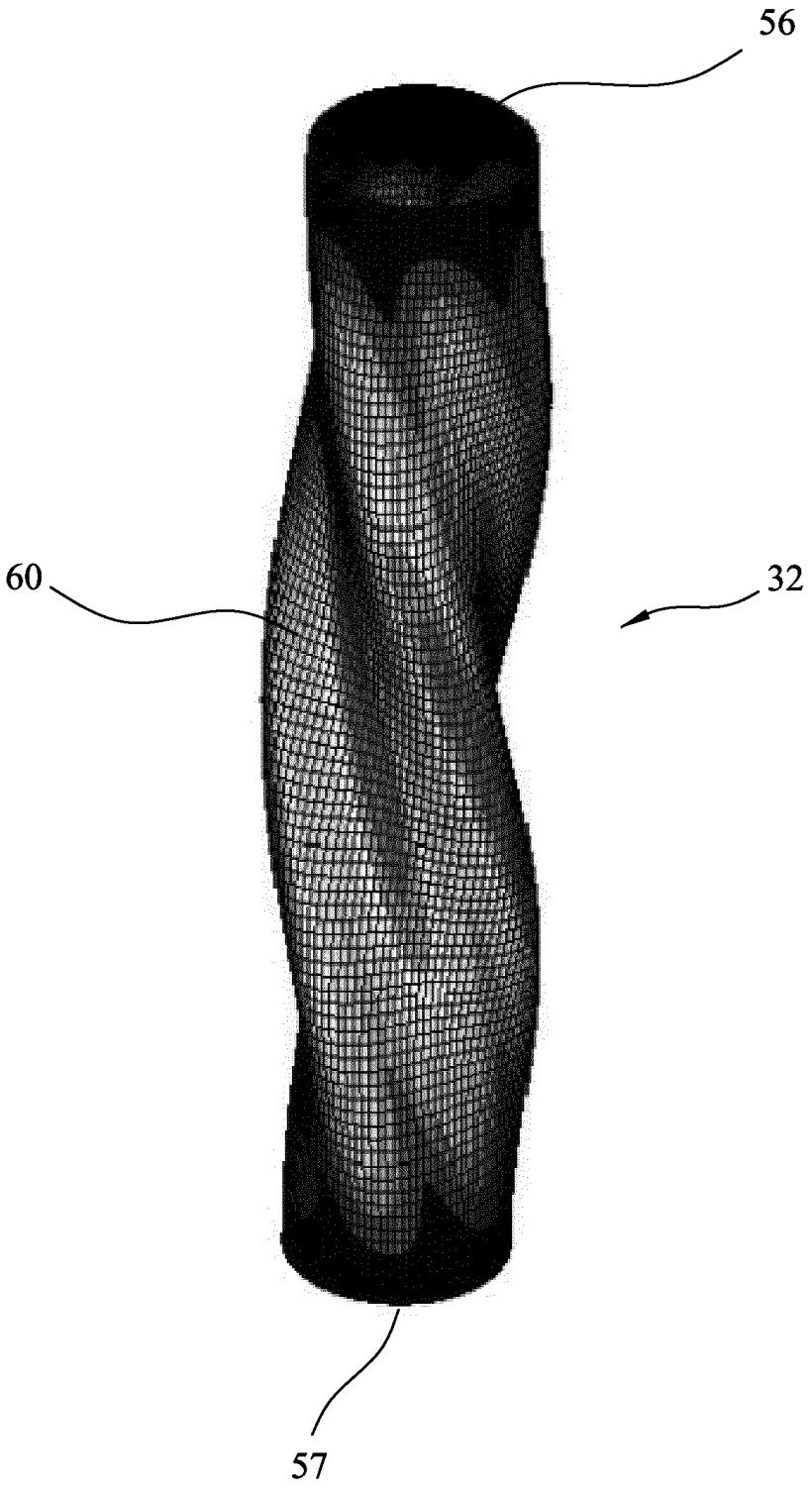
FIG. 5 is a schematic illustration of a torsion rod forming a part of a drive transmission of the inertia cone crusher of FIG. 4.

Accordingly, each of the torsion components 54, 59, 58 are connected to one another at their respective ends in series so as to transmit drive torque from drive shaft 36 to bushing 26 and reaction torque from unbalanced weight 30 to drive shaft 36. When transmitting the drive, the force transmission pathway from drive shaft 36 extends into the radially innermost rod or tube 59, into the intermediate tube 58, then into the radially outer tube 54 and then into the bushing 26 via mount 15. FIG. 5 illustrates schematically the configuration of torsion rod 53 configured to twist between the axial end mounts 56, 57 such that the axial structure of the torsion rod 53 adopts a helical twisted profile indicated generally by reference 60.

Figure 6:
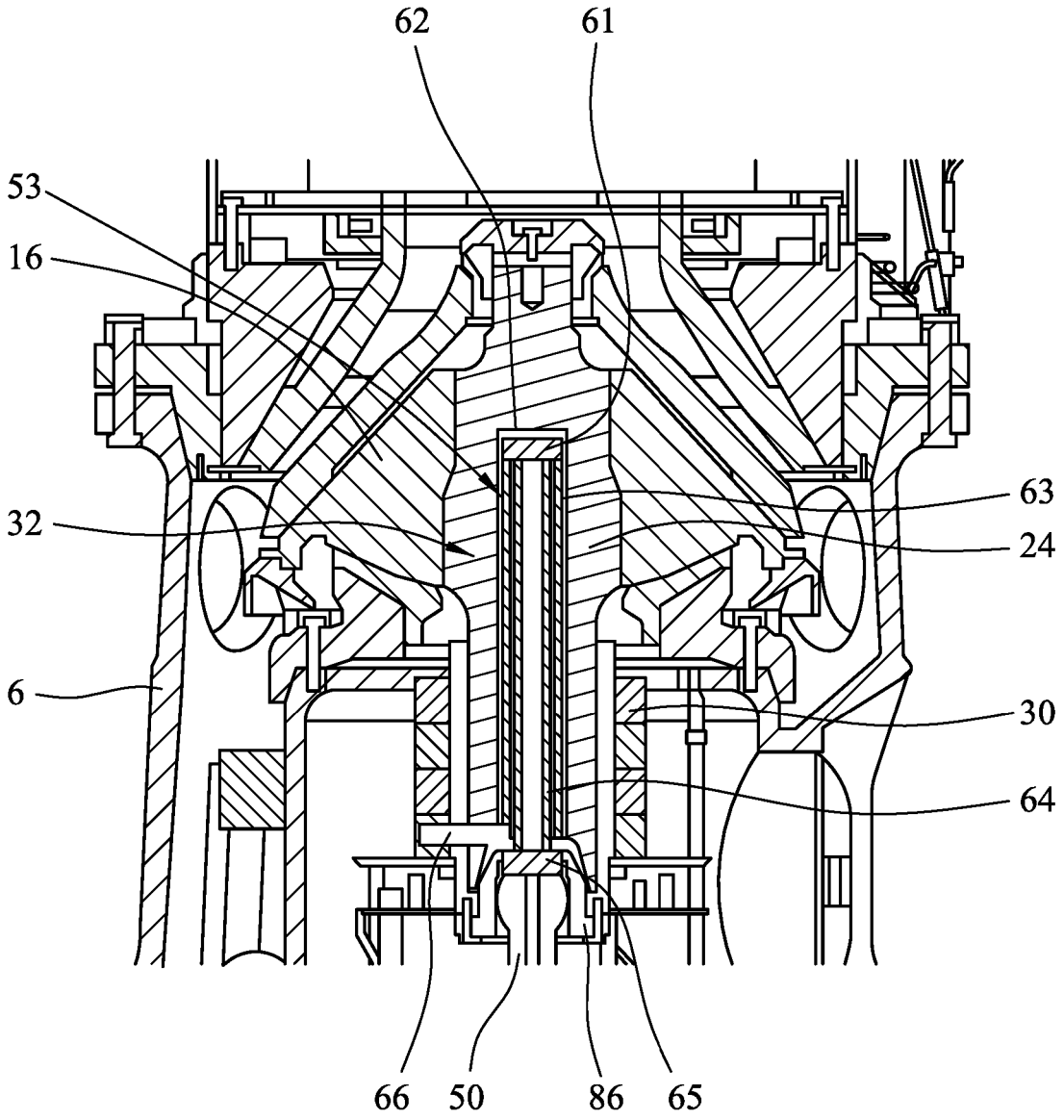
FIG. 6 is a cross-sectional view of an inertia cone crusher according to a further specific implementation of the present invention.

FIG. 6 illustrates a variation on the embodiment of FIGS. 4 and 5 that comprises a corresponding modular torsion rod indicated generally by reference 53 accommodated within an elongate bore 62 extending axially within main shaft 24. Bore 62 extends between a bearing race 86 (mounted at shaft end 31) that receives the axial upper end of the upper torsion rod 50 to an axial region of shaft 24 about which head 16 is mounted.

Like the embodiment of FIGS. 4 and 5, torsion rod 53 comprises an outer tube 63 and a corresponding coaxial inner tube 64 with both tubes 63, 64 connected via their respective upper and lower ends via mounts 61 and 65. A mounting 66 connects outer tube 63 to the unbalanced weight 30 whilst lower mounting 65 connects the inner tube 64 to the bearing race 86. Accordingly, both the drive and opposed reaction torque are transmitted through torsion rod 53 along the axial length of each tube 63, 64 with each tube configured to twist elastically as illustrated in FIG. 5. Accordingly, torsion rod 53 comprises a sufficient stiffness to transmit the drive torque whilst comprising a torsional flexibility to receive the reaction torque and to deform within bore 62.

Figure 7:
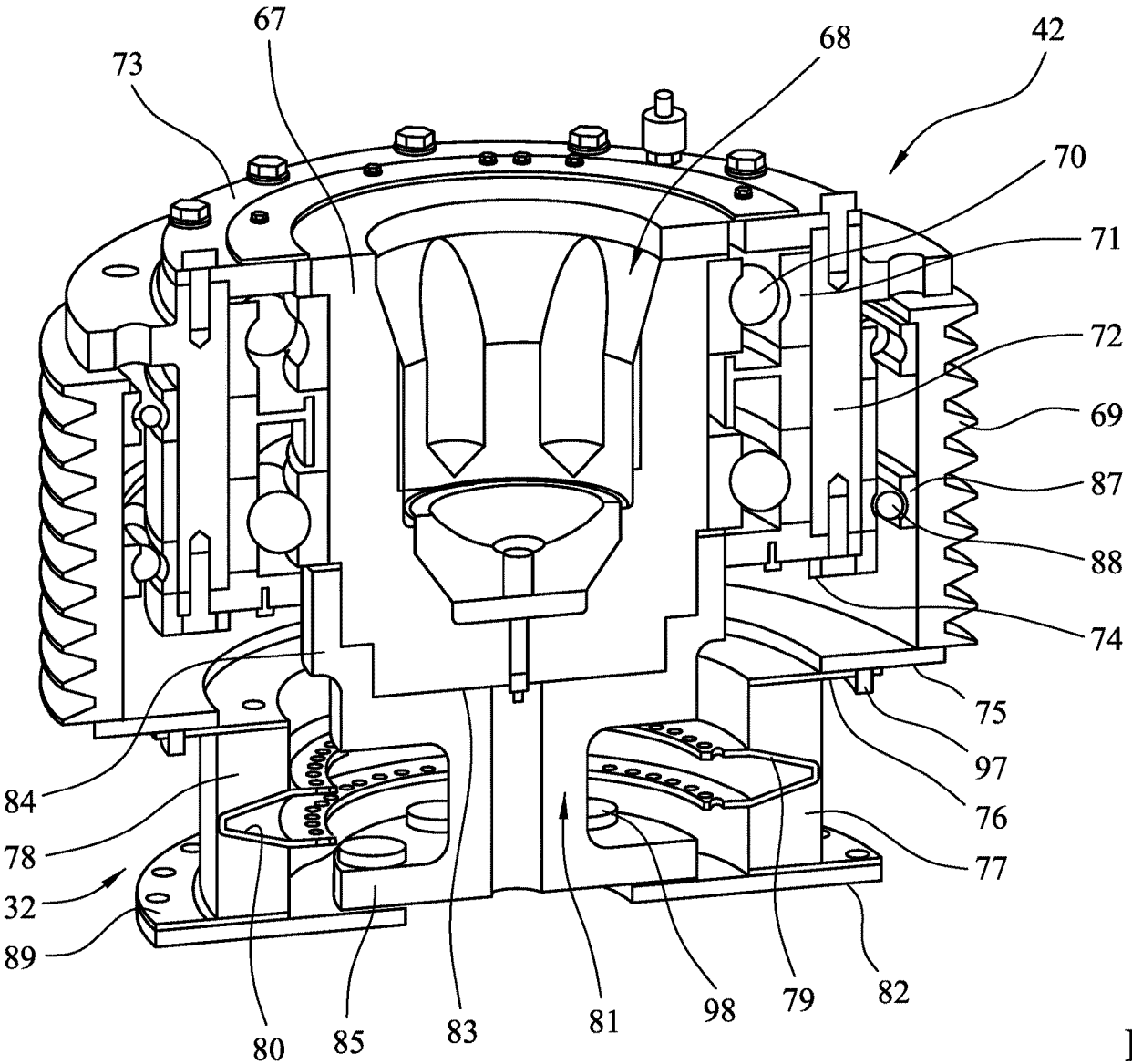
FIG. 7 is a perspective cross-sectional view through a drive pulley component of an inertia cone crusher according to a specific implementation of the present invention.

A further embodiment of the torque reaction coupling is described with reference to FIG. 7 in which the drive pulley 42 of FIG. 1 is modified to include a resiliently deformable component 32. In particular, pulley 42 comprises a radially outermost grooved race 69 around which extend V-belts 41. A radially inner race 67 defines a socket 68 to receive the lower end 38 of lower torsion bar 37. An inner bearing assembly, comprising bearings 70 and bearing raceways 71, is mounted radially outside inner race 67 and secured in position via an upper mounting disc 73 and a lower mounting disc 74. An adaptor shaft indicated generally by reference 81 comprises a radially outward extending axially upper cup portion 84 non-moveably attached to a lower region 83 of inner race 67. Adaptor shaft 81 also comprises a radially outward extending flange 85 provided at a lowermost end of shaft 81. An outer bearing assembly, comprising bearings 88 and bearing raceways 87, is positioned radially between the grooved radially outer race 69 and a bearing housing 72 that is positioned radially between the two bearings assemblies 87, 88 and 70, 71. Accordingly, the outer grooved race 69 is capable of independent rotation relative to the inner race 67 via the respective bearing assemblies 70, 71 and 87, 88.

The flexible torsion coupling 32 is positioned in the drive transmission pathway between the grooved pulley race 69 and the inner race 67 via adaptor shaft 81. According to the specific implementation, coupling 32 comprises a modular assembly formed from deformable elastomeric rings and a set of intermediate metal disc springs. In particular, a first annular upper elastomer ring 78 mounts at its lowermost annular face a first half of a disc spring 79. A corresponding second lower annular elastomer ring 77 similarly mounts at its upper annular face a second half of the disc spring 80 to form an axially stacked assembly in which the metal disc spring 79, 80 separates respective upper and lower elastomeric rings 78, 77. A first upper annular metal flange 76 is mounted at an upper annular face of the upper elastomer ring 78 and a corresponding second lower metal flange 89 is attached to a corresponding axially lower face of the lower elastomer ring 77. Upper flange 76 is attached at its radially outer perimeter to a first upper adaptor flange 75 formed from an elastomer material. Flange 75 is secured at its radially outer perimeter to a lower annular face of the grooved belt race 69. Accordingly, adaptor flange 75 and coupling flange 76 provide one half of a mechanical coupling between the grooved V belt race 69 and the flexible coupling 32. Similarly, a second lower adaptor flange 82, also formed from an elastomer material, is mounted to the lower coupling flange 89 at a radially outer region and is mounted to adaptor shaft flange 85 at a radially inner region. Accordingly, adaptor flange 82 provides a second half of the mechanical connection between flexible coupling 32 and inner face 67 (via adaptor shaft 81). Each of the elastomeric components 75, 78, 77, 82 are configured to elastically deform in response to torsional loading in a first rotational direction due to the drive torque and in the opposed rotational direction by the reaction torque. Lower adaptor flange 82 is specifically configured physical and mechanical to be stiffer in torsion relative to components 77, 78, 75 but to be deformable axially so as to provide axial freedom and to allow components 78, 77 to flex in response to the torque loading.

Flexible coupling 32 is demountably interchangeable at pulley 42 via a set of releasable connections. In particular, upper coupling flange 76 is releasably mounted to adaptor flange 75 via attachments 97 (such as bolts) and lower coupling flange 89 is releasably attached to adaptor flange 82 via corresponding attachments (not shown). Additionally, lower adaptor flange 82 is releasably attached to the adaptor shaft flange 85 via releasable attachment bolts 98. According to further embodiments, adaptor shaft end portion 84 is demountable attached to race lower end region 83 to allow the interchange of different configurations of shaft 81.

In the mounted position at pulley 42, the elastomeric components 78, 77, 75, 82 in addition to the metal disc spring 79, 80 are configured to deform radially and axially via twisting and axial and radial compression and expansion in response to the driving and reaction torques. Coupling 32, as with the embodiments of FIGS. 1 to 6, is accordingly configured to dissipate the undesired reaction torque created by the change in the tilt angle $\alpha$ and the non-circular orbiting motion of the unbalanced weight 30. In particular, coupling 32 is configured specifically to absorb these torques and inhibit onward transmission to the drive components, in this example, the readily outer grooved V-belt race 69.

Figure 8:
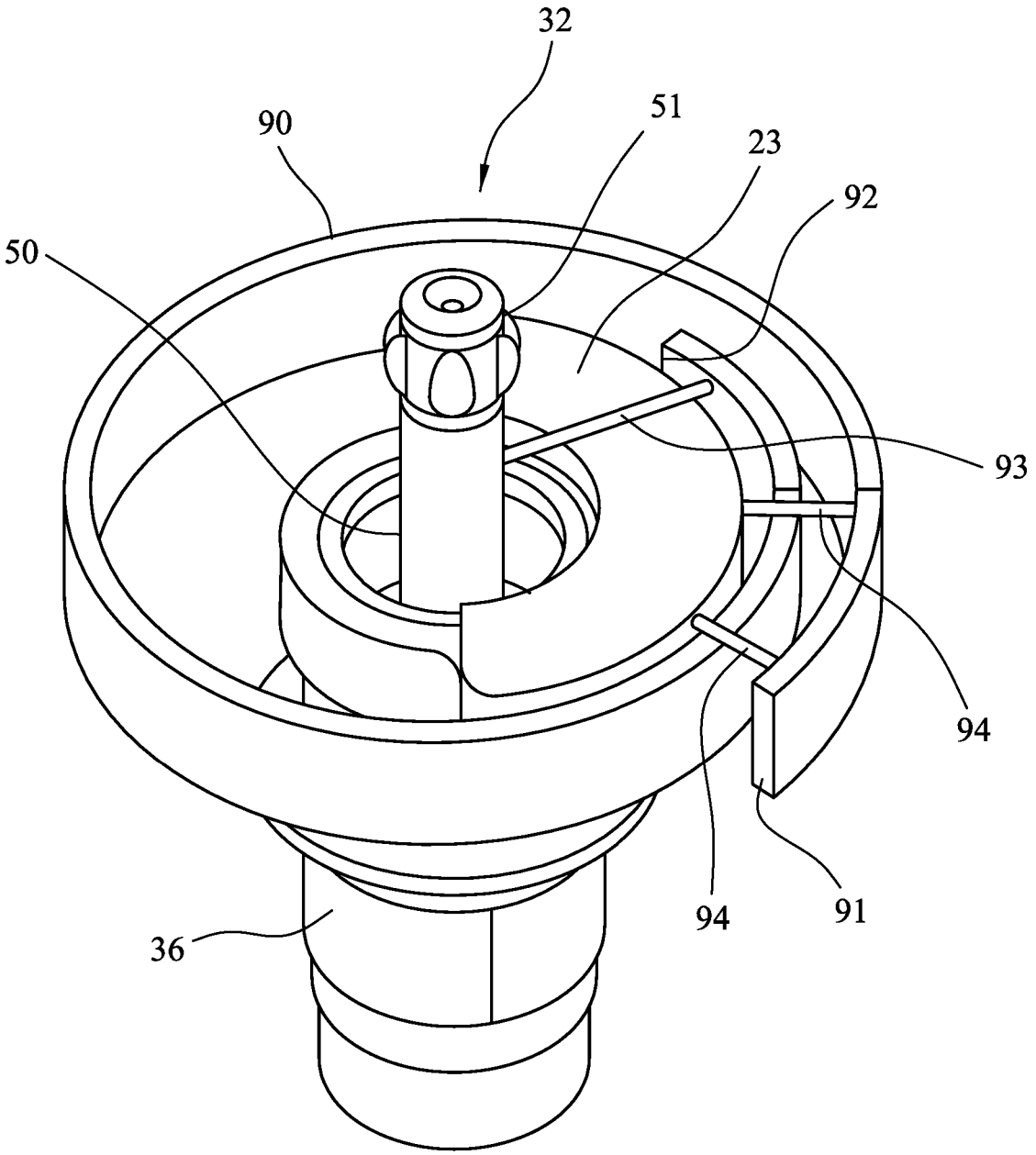
FIG. 8 is a schematic perspective view of a torque reaction coupling mounted about an unbalanced weight of an inertia cone crusher according to a further specific implementation.

A further implementation of a flexible elastic torsion transmission coupling is described with reference to FIG. 8 in the form of a coil or clock spring indicated generally by reference 90. According to the specific implementation, spring 90 comprises a rectangular cross-sectional shape profile and is formed from an elongate metal strip coiled into a circular spiral having a first end 91 and a second end 92 with each end 91, 92 overlapping one another in the circumferential direction. As will be appreciated, the coil spring 90 may comprise one single circular turn or may comprise a plurality of spiral turns each extending through 360°. Spring 90 is positioned radially outside unbalanced weight 30 at the region of an axial upper end 51 of an upper torsion bar 50. In particular, spring first end 91 is secured via a rigid connection 94 to a region of unbalanced weight 30 and spring second end 92 is secured via a rigid connection 93 to torsion bar 50. Accordingly, spring 90 is positioned in the drive transmission pathway between unbalanced weight 30 and upper torsion bar 50. As such, spring 90 is configured to dynamically coil and uncoil in response to both the driving torque from a drive pulley and a reaction torque created by the motion of unbalanced weight 30.

Figure 9:
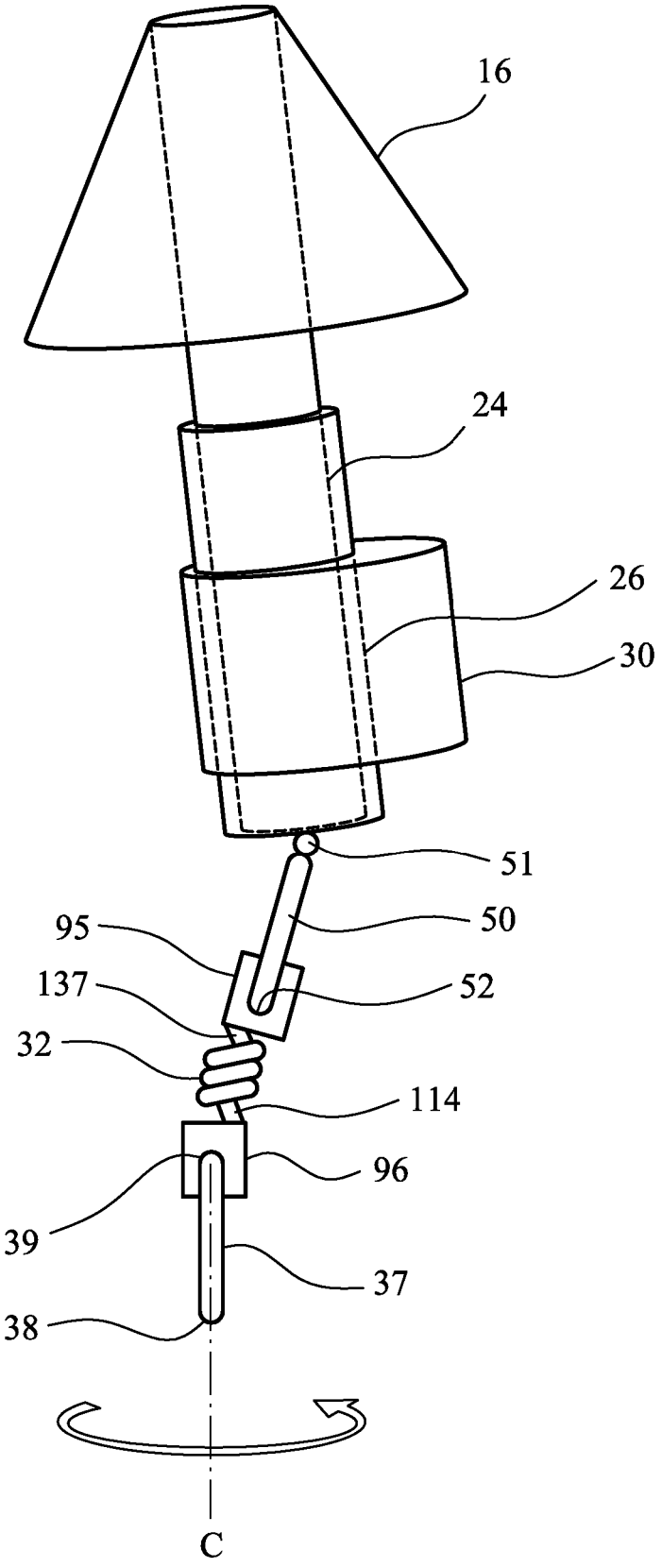
FIG. 9 is a schematic illustration of selected components of an inertia cone crusher including a crusher head, unbalanced weight and drive transmission components according to a further specific implementation of the present invention.

Referring to FIG. 9, a further embodiment of the flexible torsional response coupling 32 is described in the form of a helical spring 32 mounted axially between upper and lower torsion bars 50, 37. In particular, a first axially upper end 137 of spring 32 is rigidly mounted to a first CV bushing 95 that mounts and rotationally supports an axially lower end 52 of upper torsion bar 50. A corresponding second lower axial end 114 of spring 32 is rigidly attached to a second CV bushing 96 that mounts and rotationally supports an axial upper end 39 of lower torsion bar 37. The respective upper end 51 of upper torsion bar 50 is attached to shaft bushing 26 at described with reference to FIG. 3 and the axial lower end 38 of lower torsion bar 37 is mounted to pulley 42 as described with reference to FIG. 1. Accordingly, spring 32 provides the torsional elastic deformation characteristic to inhibit transmission of the reaction torque from the motion of unbalanced weight 30 into the lower drive components 37 and 42. As with all of the embodiments described herein, the unbalanced weight 30 via deformable coupling 32 may be considered to be held in a 'floating' relationship relative to at least some of the drive transmission components to provide a degree of independent rotational movement between unbalanced weight 30 and selected components of the drive transmission 55.

Figure 10:
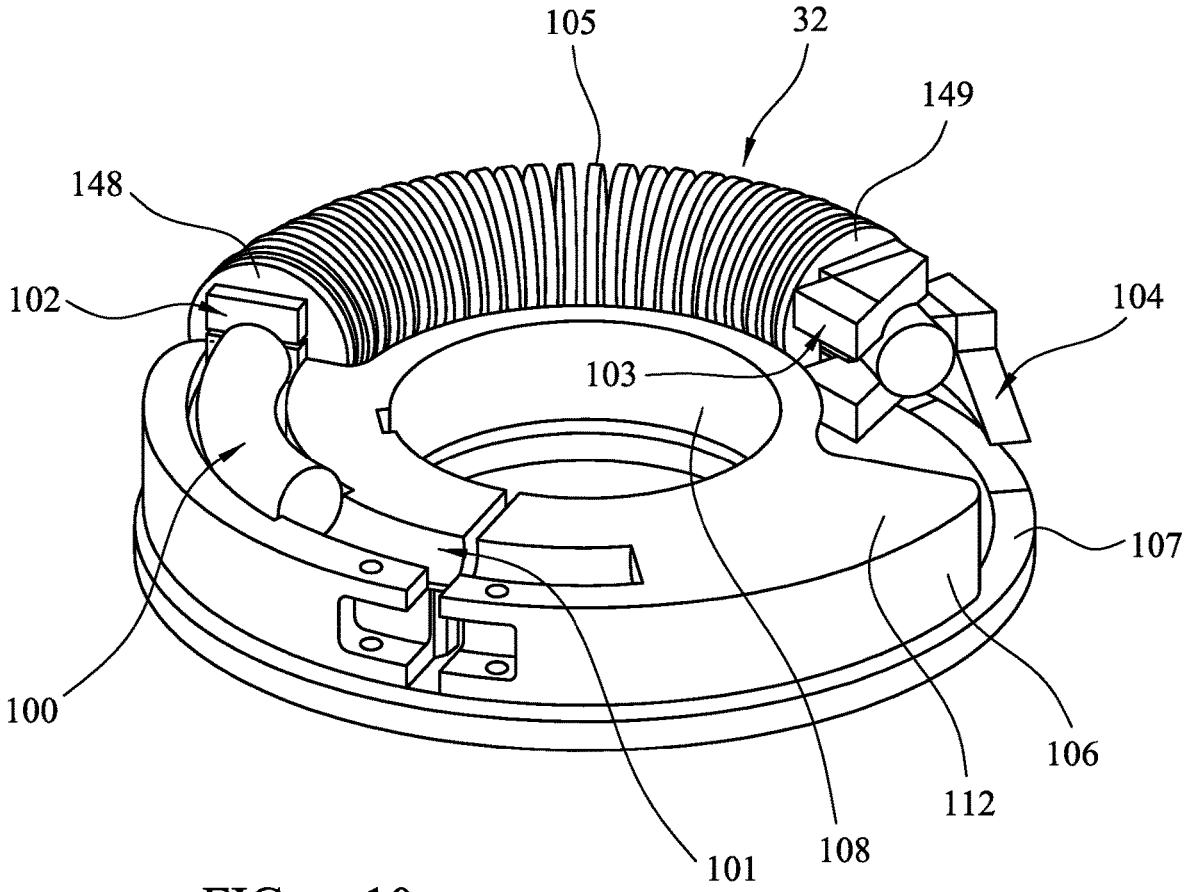
FIG. 10 is a further specific implementation of a torque reaction coupling forming part of a drive transmission within an inertia cone crusher.
Figure 11:
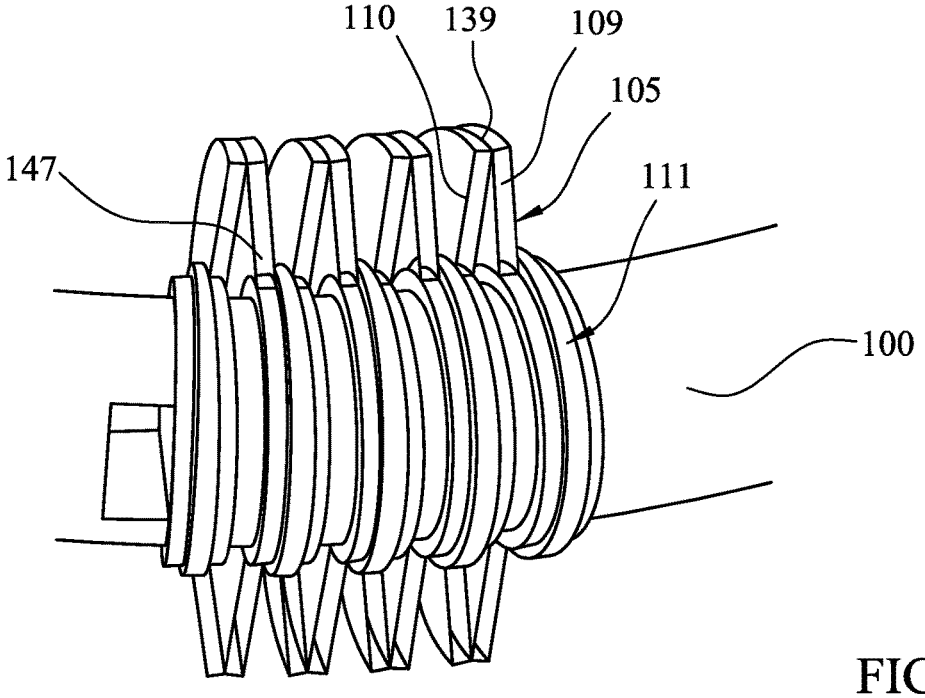
FIG. 11 is a magnified perspective view of a disc spring part of the torque reaction coupling of FIG. 10.
Figure 12:
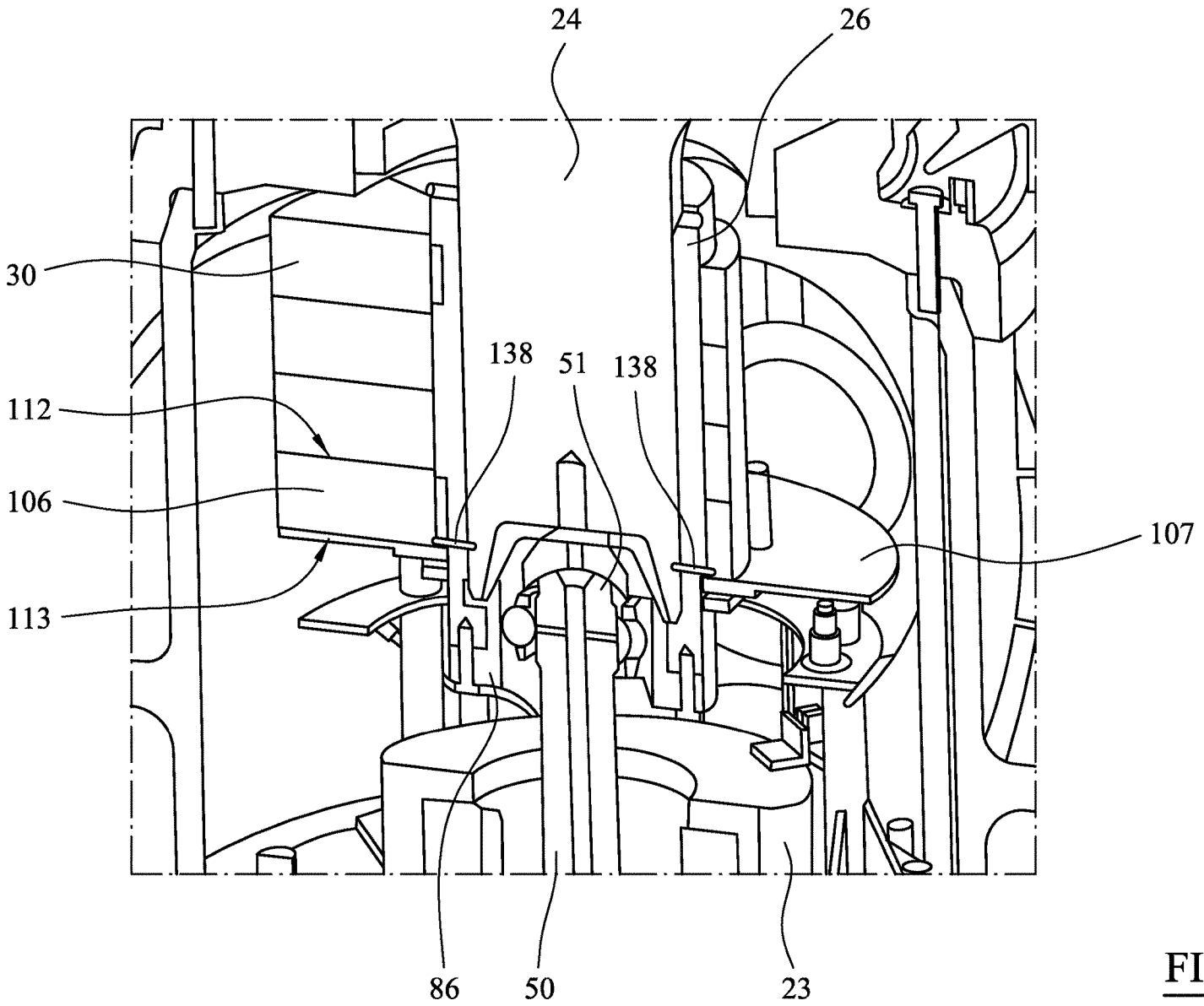
FIG. 12 is a partial cross-sectional view through an inertia cone crusher with the torque reaction coupling of FIGS. 10 and 11 mounted in position as part of the unbalanced weight according to a specific implementation of a present invention.

A further specific implementation is described with reference to FIGS. 10 to 12. According to the further embodiment, torque reaction coupling 32 is implemented as a torsional disc spring mounted between the unbalanced weight 30 and the bearing race 86 (illustrated in FIG. 6) that mounts and rotationally supports the axial upper end 51 of upper torsion bar 50. A torsion disc spring 32 is formed integrally with the unbalanced weight 30 and is configured to sit within a stack of generally annular unbalanced weight segments. In particular, one segment 106 of the unbalanced weight 30, corresponding to an axially lowermost segment of the stack (that is positioned in contact with a movement sensing plate 107) is adapted to at least partially accommodate the torsional disc spring 32. Segments 106 is annular and comprises bore 108 for mounting about bushing 26. Referring to FIG. 12, the spring indicated generally by reference 105 is positioned between the upper and lower faces 112, 113 of weight segment 106. A circumferentially extending groove 101 is recessed into upper face 112 of weight segment 106 and at least partially mounts an arcuate slider axle 100. A plurality of annular disc spring segments are slidably mounted on axle 100 between its first and second ends. Each segment comprises a pair of annular discs or rings 109, 110 connected at their radially outermost perimeters and aligned transverse to one another so as to be capable of hinging about their combined annular perimeter junction 139. A radially inner end 147 of each ring 109, 110 is attached to a respective slider ring 111 slidably mounted over axle 100. Accordingly, each segment comprising rings 109, 110 is capable of compressing and expanding in the axial direction of axle 100. A first stopper 102 and second stopper 103 are mounted about axle 100 at the respective ends 148, 148 of disc spring 105. Each stopper 102, 103 is connected to the unbalanced weight 30. A torsional input coupling 104 is mounted at spring second end 149 such that spring 105 is configured to compress and expand axially along axle 100 in response to the reaction torque as described herein. Additional bearing surfaces 138 at the axially lower region of bushing 26 further assist with the transmission of axial loads at the region of the torsion spring 105.

Figure 14:
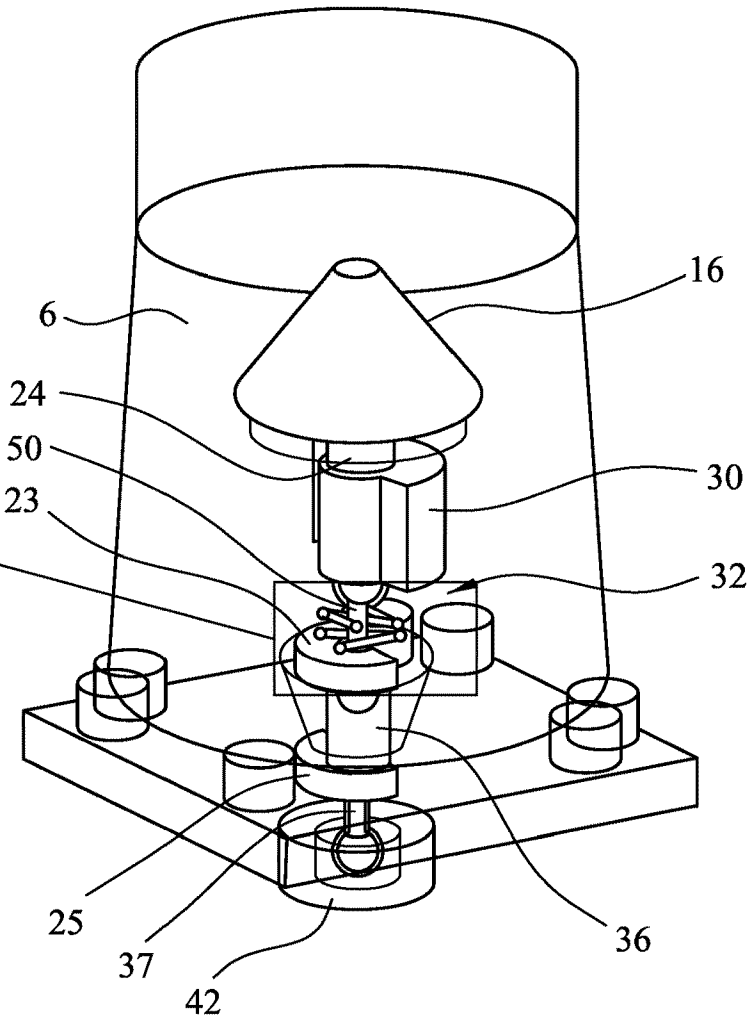
FIG. 14 is a schematic illustration of the torque reaction coupling of FIG. 13 mounted in position within the drive transmission between a crushing head and a drive input component.
Figure 13:
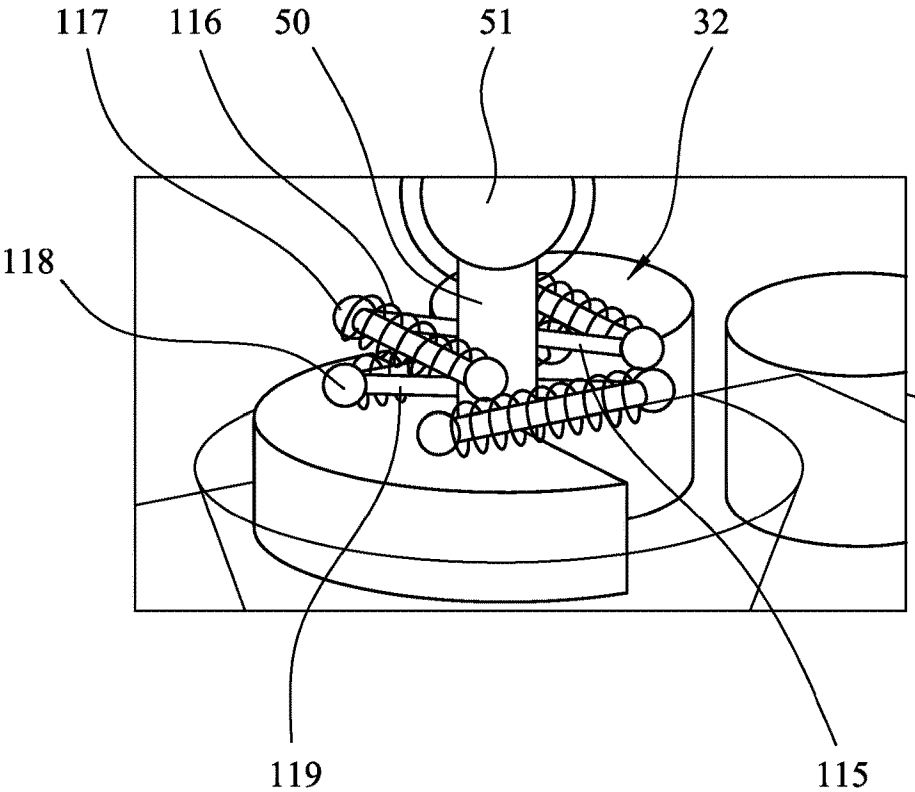
FIG. 13 is a schematic perspective view of a further embodiment of the torque reaction coupling forming part of a drive transmission within an inertia cone crusher.

According to a further embodiment of FIGS. 13 and 14, torque reaction coupling 32 is implemented as an assembly of axial compression springs positioned between the unbalanced weight 30 and an upper torsional bar 50. The spring assembly comprises a set of slider compression spring arrangements distributed radially outside the upper torsion bar 50. Each slider arrangement comprises an axle 119 that slidably mounts a spring guide 118 configured for linear movement along axle 119. A helical spring 116 extends axially around axle 119 and is positioned to extend between guide 118 (mounted at one end of axle 119) and a spring holder 117 (mounted at an opposite end of axle 119). Accordingly, each helical spring 116 is sandwiched between guide 118 and holder 117. Each holder 117 is secured to torsion bar 50 via link arm 115 and the flexible coupling is secured to the unbalanced weight 30 via the guides 118. Accordingly, the drive and reaction torques may be transmitted through the spring assembly such that non-circular motion of weight 30 about the gyration axis G forces each guide 118 to slide along axle 119 with the motion being controlled by the linear compression and extension of each respective spring 116. Accordingly, exaggerated dynamic torsion is transmitted into the spring arrangement where they are dissipated and inhibited from onward transmission into the upper torsion bar 50.

Figure 15:
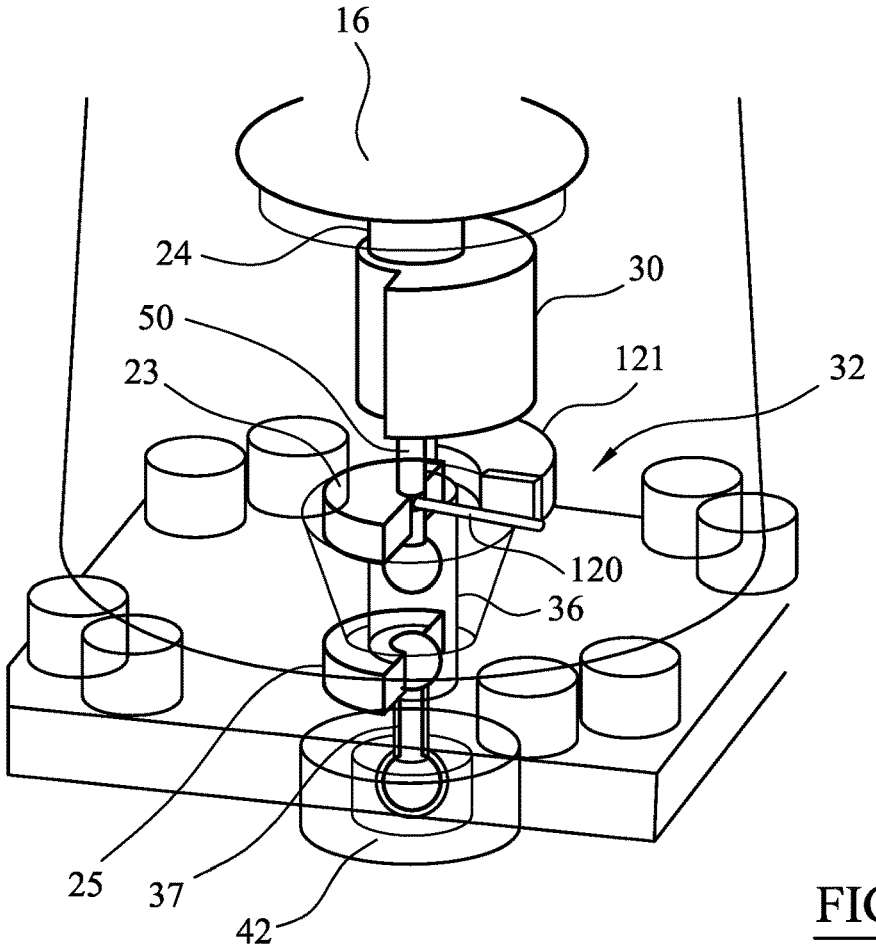
FIG. 15 is a schematic illustration of a further implementation of the torque reaction coupling positioned in the drive transmission between an unbalanced weight and a drive component.
Figure 16:
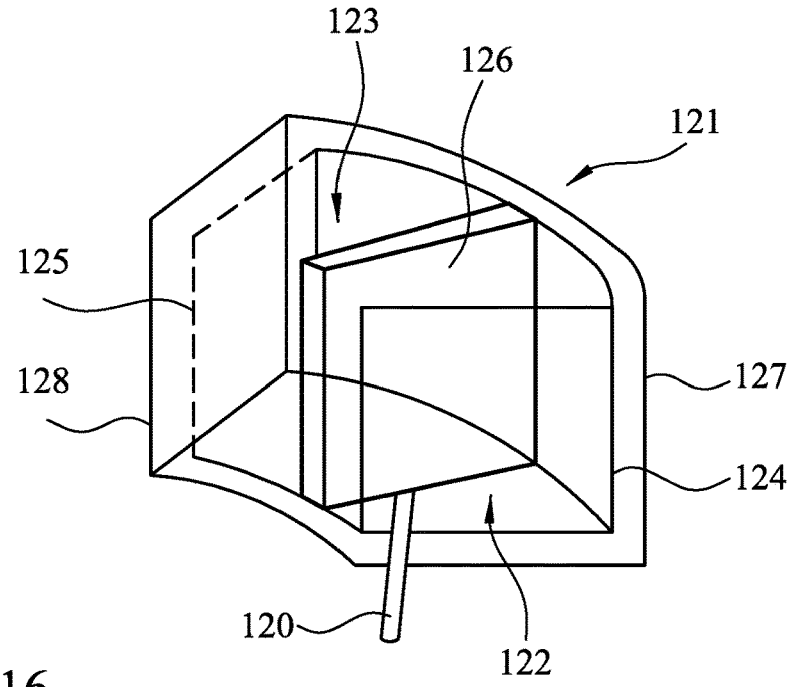
FIG. 16 is a further magnified perspective view of the torque reaction coupling of FIG. 15.

FIGS. 15 and 16 illustrate a further implementation of the dynamically reactive coupling 32 in a form of an air spring indicated generally by reference 121. According to the specific implementation, air spring 121 is integrated within the unbalanced weight 30 in a similar manner to that described for the embodiment of FIGS. 10 to 12. In the specific implementation, air spring 121 comprises an internal chamber defined by a housing having a first end 127 and a second end 128. The internal chamber similarly comprises a first end 124 and a second end 125 that are partitioned by a slider plate 126 extending across the internal chamber. Accordingly, the internal chamber is divided into a first chamber 122 and second chamber 123 either side of slider plate 126 in between the respective ends 124, 125. A rigid connection mounting 120 extends from slider plate 126 and is attached to an upper torsion bar 50. Housing second end 128 is attached to a region of the unbalanced weight 30. Accordingly, in response to torsion transmitted to the air spring 121 from the undesired deflected motion of unbalanced weight 30, the slider plate 126 is configured to slide between chamber ends 124, 125. A fluid within one or both chamber halves 122, 123 is forced to compress (or expand) in response to the sliding of plate 126 so as to provide the elastic deformation and torsional reaction. Accordingly, air spring 121 via the choice of fluid, pressure and/or volume of the fluid within chamber halves 122, 123 may be single or dual acting in response to the reaction torques transmitted respectively into the coupling 121 from the non-circular orbiting motion of unbalanced weight 30.

Figure 17A:
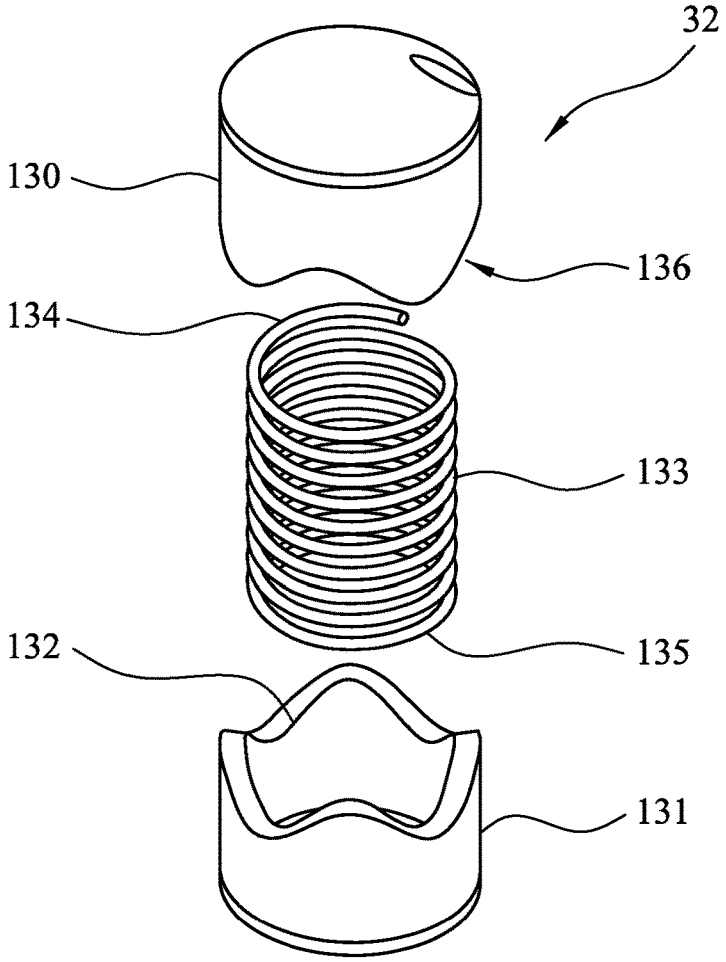
FIG. 17A is an exploded view of a further specific implementation of a torque reaction coupling.
Figure 17B:
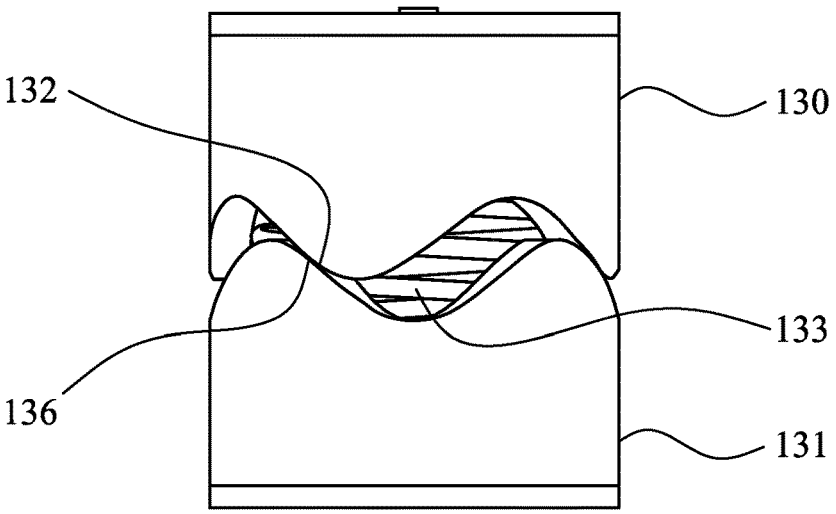
FIG. 17B is an assembled view of the specific implementation of a torque reaction coupling of FIG. 17A.

Referring to FIGS. 17A and B, the torque reaction coupling 32 may in one implementation be represented as a camming joint at the region of an upper torsion rod 50. In particular, rod 50 is divided into at least two axial segments including a lower segment 131 and an upper segment 130. Lower segment 131 comprises an upward facing camming surface 132 and upper segment 130 comprises a corresponding downward facing camming surface 136 opposed to the camming surface 132 of the lower segment 131. A spring 133 is positioned to extend between and axially couple the respective camming surfaces 132, 136 and is attached at its first and second ends 134, 135 to the respective axial segments 131, 130 of torsion bar 50. Accordingly, the camming and spring assembly provides a flexible joint to dissipate the exaggerated torsion resulting from the motion of unbalanced weight 30 as the camming surfaces 132, 136 are forced towards one another. In particular, spring 133 compresses or expands due to differences in torsion between the upper and lower segments 130, 131 of the torsional bar 50 so as to bias together the two segments 130, 131. According to the specific implementation camming surfaces 136, 132 each comprise a 'wave' type profile extending in the circumferential direction at one end of a short cylindrical wall segment that, in part, defines each of the respective upper and lower segments 130, 131.

Figure 18:
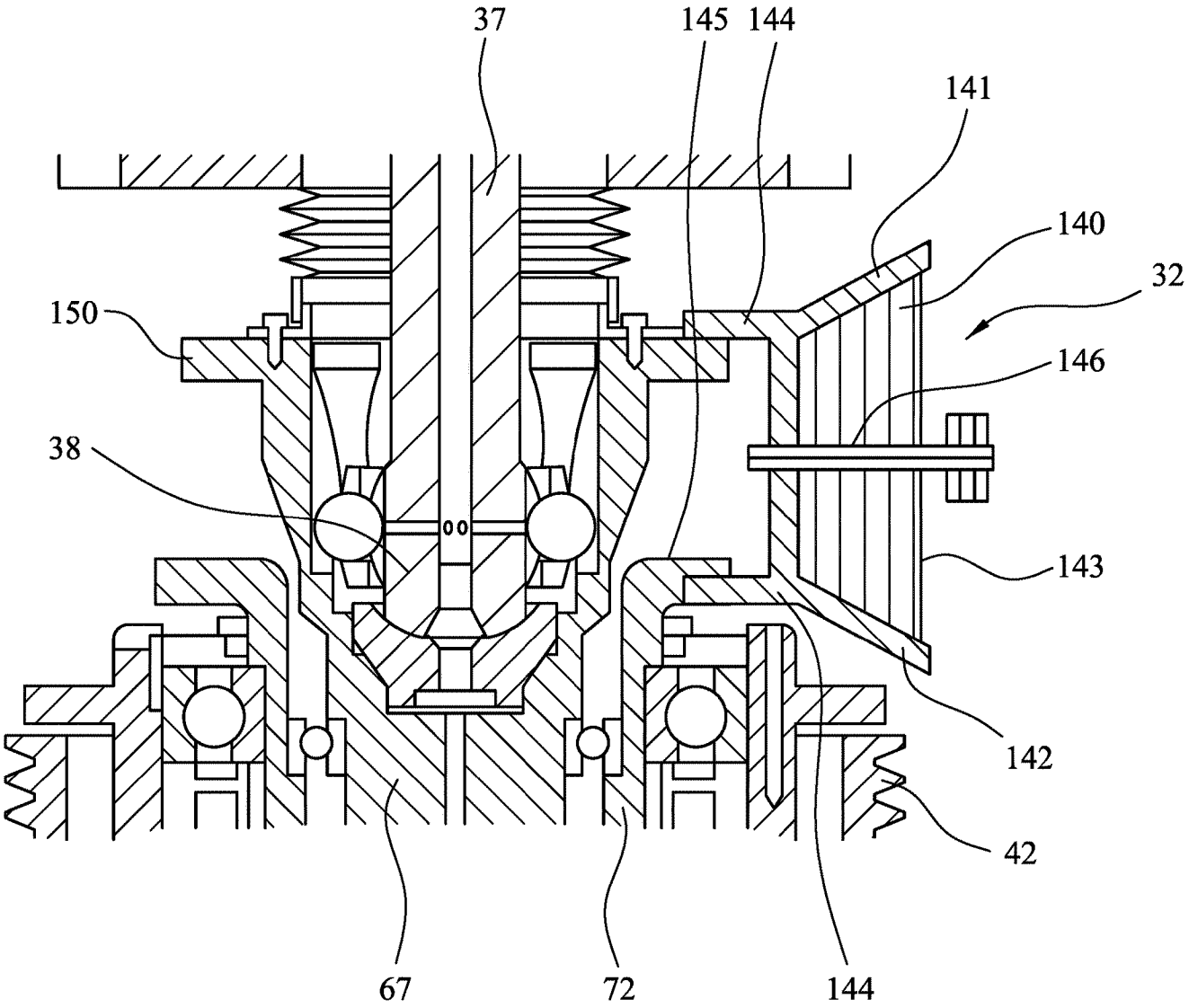
FIG. 18 is a further specific implementation of a torque reaction coupling mounted in position between selected drive transmission components within an inertia cone crusher.

The torsional responsive coupling 32 is described according to a further embodiment with reference to FIG. 18. Coupling 32 is positioned towards an axially lower region of the drive transmission 55 between a lower torsion bar 37 and a drive pulley 42. Being similar to the embodiment of FIG. 7, coupling 32 comprises a modular assembly construction having first and second elastomeric rings 140, 143 secured between respective upper and lower mounting plates 141, 142. A metal disc spring 146 partitions the upper and lower elastomeric rings 140, 143 and is configured to allow a degree of independent rotational motion of rings 140, 143 resulting from torque induced by the motion of unbalanced weight 30. Lower plate 142 is mounted at its radially inner region 144 to a radially outward extending flange 145 projecting from bearing housing 72 as described with reference to FIG. 7. Similarly, a radially inner region 144 of upper plate 141 is coupled to a radially outward extending flange 150 projecting from an upper region of inner race 67 that supports lower torsion rod 37 as described with reference to FIG. 7. Accordingly, drive and reaction torque is transmitted between bearing housing 72 and inner race 67 via flexible coupling 32. Accordingly, the undesirable reaction torque is dissipated dynamically by the rotational twisting of elastomer rings 140, 143 and the movement of the intermediate disc spring 146.

As will be appreciated, the specific embodiments of FIGS. 1 to 18 are example implementations of an elastically deformable torsion response coupling positioned between a part of the drive transmission 55 and the unbalanced weight 30. In particular, according to further embodiments, torsion transmission coupling 32 may provide a direct couple between pulley 42 and bushing 26 according to the embodiment of FIG. 1 that would obviate the need for drive shaft 36 and lower torsion bar 37. Similarly and by way of example only, the coil spring embodiment of FIG. 8 may be implemented at a position directly between unbalanced weight 30 (or bushing 26) and upper torsion bar 50.

In preferred embodiments, coupling 32 is positioned in the drive transmission pathway closer to the unbalanced weight 30 (or bushing 26) relative to pulley 42. Such a configuration is advantageous to dissipate the reaction torque closer to source and to isolate all or most of the drive transmission components 55 from large excessive torsions. However, positioning the coupling 32 towards the lower region of crusher 1 at or close to drive pulley 42 is advantageous for installation, servicing and maintenance of wear parts. In particular, the embodiment of FIG. 7 is advantageous to allow convenient interchange of different configurations of flexible coupling 32 at the axially lower region of pulley 42 to suit crushing material and desired operating parameters that may affect the magnitude and frequency of the reaction torque.

The invention claimed is:

1. A drive mechanism comprising:

a drive input component forming part of a drive transmission, wherein the drive input component is arranged to rotate an unbalanced mass body located within an inertia crusher and to cause a crusher head to rotate about a gyration axis; and a torque reaction coupling positioned at the drive transmission between the unbalanced mass body and the drive input component and being elastically displaceable and/or deformable, the torque reaction coupling being configured to: i) transmit a torque from at least part of the drive input component to at least part of the mass body via a drive transmission component which is coupled to the mass body, and ii) to dynamically displace and/or deform elastically in response to a change in the torque resultant from a change in rotational motion of the crusher head about the gyration axis and/or a rotational speed of the crusher head so as to dissipate the change in the torque at the inertia crusher, the torque reaction coupling being a spring selected from a helical spring or a coil spring.

2. The drive mechanism as claimed in claim 1, wherein the crusher head supports an inner crushing shell, the mass body being provided at or connected to the crusher head.

3. The drive mechanism as claimed in claim 2, wherein the mass body is connected to the crusher head via a main shaft or the mass body is integrated at or mounted within the crusher head.

4. The drive mechanism as claimed in claim 1, further comprising at least one further drive transmission component coupled to the mass body and the drive input component to form part of the drive transmission.

5. The drive mechanism as claimed in claim 4, wherein the torque reaction coupling is elastically deformable relative to the drive input component and/or the further drive transmission component.

6. The drive mechanism as claimed in claim 1, wherein the torque reaction coupling includes a torsion bar.

7. The drive mechanism as claimed in claim 1, wherein the spring has a stiffness in the range 100 Nm/degrees to 1500 Nm/degrees and a damping coefficient (Nm·s/degree) of less than 5% of the stiffness.

8. The drive mechanism as claimed in claim 1, wherein the torque reaction coupling includes a first part anchored to the mass body or a component coupled to the mass body and a second part anchored to the drive input component or a coupling forming part of the drive transmission and coupled to the drive input component such that the torque reaction coupling is elastically displaceable and/or deformable in an anchored position between the drive input component and the mass body.

9. The drive mechanism as claimed in claim 1, wherein the torque reaction coupling is configured and mounted in the drive transmission to store the change in the torque and to displace and/or deform relative to the drive input component to inhibit transmission of the change in the torque to at least part of the drive transmission.

10. The drive mechanism as claimed in claim 1, wherein the torque reaction coupling is configured to displace and/or deform in response to the change in the torque due to deviations from a substantially circular motion of the crusher head around the gyration axis.

11. An inertia crusher comprising:

a frame arranged to support an outer crushing shell;

a crusher head moveably mounted relative to the frame to support an inner crushing shell to define a crushing zone between the outer and inner crushing shells; and a drive mechanism according to claim 1.

12. A method of operating an inertia crusher comprising:

inputting a torque to a drive input component at the crusher forming part of a drive transmission;

transmitting drive from the drive input component to an unbalanced mass body via a torque reaction coupling to cause a crusher head to rotate about a gyration axis formed by an axis of the crusher head relative to the gyration axis;

partitioning the drive transmission between the drive input component and the mass body via an elastically displaceable and/or deformable torque reaction coupling configured to allow the torque to be transmitted from the drive input component to the mass body, the torque reaction coupling being a spring selected from a helical spring or a coil spring; and inhibiting the transmission of a change in the torque resultant from a change in the rotational motion of the crusher head about the gyration axis and/or a rotational speed of the crusher head to at least part of the drive transmission via displacement and/or deformation of the torque reaction coupling.

* * * * *